US010912344B2

(12) United States Patent
Bohn et al.

(10) Patent No.: US 10,912,344 B2
(45) Date of Patent: Feb. 9, 2021

(54) HELMET WITH ACCESSORY ATTACHMENT RAIL

(71) Applicant: MSA Technology, LLC, Cranberry Township, PA (US)

(72) Inventors: Alexa Danielle Bohn, Pittsburgh, PA (US); Robert Edward Klotz, Jefferson Hills, PA (US); Daniel Martin Hehman, Cranberry Township, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 183 days.

(21) Appl. No.: 16/207,842

(22) Filed: Dec. 3, 2018

(65) Prior Publication Data

US 2020/0170329 A1 Jun. 4, 2020

(51) Int. Cl.

| | |
|---|---|
| ***A42B 3/18*** | (2006.01) |
| ***A42B 3/04*** | (2006.01) |
| ***A42B 3/16*** | (2006.01) |
| ***A42B 3/22*** | (2006.01) |

(52) U.S. Cl.

CPC ..... *A42B 3/185* (2013.01); *A42B 3/04* (2013.01); *A42B 3/0406* (2013.01); *A42B 3/16* (2013.01); *A42B 3/221* (2013.01); *A42B 3/222* (2013.01)

(58) Field of Classification Search

CPC ..... A42B 3/185; A42B 3/04; A42B 3/221; A42B 3/222; A42B 3/0406; A42B 3/16

See application file for complete search history.

(56) References Cited

U.S. PATENT DOCUMENTS

| | | | | |
|---|---|---|---|---|
| 3,461,463 | A * | 8/1969 | Beguin | A42B 3/166 2/423 |
| 4,222,123 | A * | 9/1980 | Hellberg | A42B 3/166 2/10 |
| 5,546,610 | A * | 8/1996 | Herzig | A42B 3/225 2/422 |
| 6,352,383 | B1 | 3/2002 | Ristola | |
| 6,851,129 | B2 * | 2/2005 | Gafforio | A42B 3/222 2/424 |
| 6,892,393 | B1 | 5/2005 | Provost et al. | |
| 7,849,517 | B2 | 12/2010 | Rogers et al. | |

(Continued)

FOREIGN PATENT DOCUMENTS

| | | |
|---|---|---|
| EP | 2004000 B1 | 2/2017 |
| WO | 2018169984 A1 | 9/2018 |

*Primary Examiner* — Khaled Annis

(74) *Attorney, Agent, or Firm* — The Webb Law Firm

(57) ABSTRACT

A protective helmet has an outer shell configured for surrounding a head of a user and at least one accessory attachment rail connected to the outer shell. The accessory attachment rail has a body having a front end, a rear end, and one or more slots between the front end and the rear end. Each of the one or more slots is configured for removably receiving at least one helmet accessory. A locking mechanism is associated with each of the one or more slots for automatically locking the at least one helmet accessory in the one or more slots upon insertion of the at least one helmet accessory within the one or more slots and for preventing removal of the at least one helmet accessory from the one or more slots. At least one connection element is provided for connecting the accessory attachment rail to the outer shell.

19 Claims, 13 Drawing Sheets

(56) References Cited

U.S. PATENT DOCUMENTS 8,166,575 B2 * 5/2012 Haselmayer ..... A42B 3/166 2/10
9,716,938 B1 * 7/2017 Hoernschemeyer ..... H04R 1/1066
10,154,704 B1 * 12/2018 Caito, III ..... A42B 3/223
10,219,579 B2 * 3/2019 Gotti ..... A42B 3/04
2004/0199982 A1 10/2004 Wang-Lee
2009/0235437 A1 9/2009 Springer et al.
2009/0307826 A1 * 12/2009 Rogers ..... A42B 3/04 2/422
2009/0313745 A1 12/2009 Kang et al.
2010/0012692 A1 * 1/2010 Harris ..... A42B 3/04 224/181
2010/0154093 A1 6/2010 Provost et al.
2011/0314594 A1 * 12/2011 Rogers ..... G02B 23/12 2/421
2012/0246807 A1 10/2012 Klotz et al.
2013/0205477 A1 * 8/2013 Pfanner ..... A42B 3/14 2/416
2013/0212787 A1 * 8/2013 Pfanner ..... A42B 3/222 2/424
2013/0219598 A1 * 8/2013 Pfanner ..... A42B 3/16 2/423
2015/0040295 A1 * 2/2015 Pfanner ..... A42B 3/14 2/411
2015/0201696 A1 * 7/2015 Pfanner ..... A42B 3/225 2/424
2015/0264992 A1 9/2015 Happel et al.
2016/0208982 A1 * 7/2016 Sharron ..... F16M 11/041
2016/0324248 A1 * 11/2016 Winters ..... A42B 1/24
2017/0049179 A1 * 2/2017 Nordin ..... A42B 3/166
2017/0112221 A1 4/2017 Gotti
2017/0112225 A1 4/2017 Gotti
2017/0127745 A1 5/2017 Daniels et al.
2017/0280807 A1 10/2017 Rogers et al.
2017/0325534 A1 11/2017 Noordzij et al.
2017/0340046 A1 * 11/2017 Le ..... H04R 1/1066
2018/0092425 A1 * 4/2018 Hall ..... A42B 3/04
2018/0168270 A1 * 6/2018 Vaccaro ..... H04R 1/105
2018/0249781 A1 * 9/2018 Zawislak ..... H04R 1/1008
2018/0292178 A1 * 10/2018 Gehring ..... A42B 3/0406
2018/0295925 A1 * 10/2018 Gagliardo ..... A42B 3/226
2019/0021910 A1 * 1/2019 Pfanner ..... A61F 11/14
2019/0101359 A1 * 4/2019 Zimmer ..... A42B 3/166
2019/0104800 A1 * 4/2019 Schuster ..... A42B 3/225
2019/0320753 A1 * 10/2019 Le ..... H04R 1/105
2019/0365009 A1 * 12/2019 Frieder ..... A42B 3/185
2020/0029646 A1 * 1/2020 Salvetti ..... A42B 3/328
2020/0077732 A1 * 3/2020 O'Connell ..... A42B 3/04
2020/0146387 A1 * 5/2020 Nimura ..... A42B 3/205

* cited by examiner

HELMET WITH ACCESSORY ATTACHMENT RAIL

BACKGROUND OF THE INVENTION

Field of the Invention

The present invention relates generally to helmets for use in various situations and environments, and in particular to a protective helmet having an accessory attachment rail configured for removably attaching one or more accessories to the protective helmet.

Description of the Related Art

Protective helmets are widely used in a variety of environments. A protective helmet typically includes a hard shell for protecting the head of the user. One or more accessories may be removably or non-removably attached to the outer surface of the hard shell of the protective helmet. In some examples, the one or more accessories may be configured to provide additional protection to the user, such as hearing or face protection. In other examples, the one or more accessories may provide additional capability, such as providing additional visibility. In several known protective helmets, the one or more accessories may be movable between a first, active position and a second, inactive position. For example, in the first position, the one or more accessories may provide the desired additional protection by, for example, extending in front of the user's face or over the user's ears. In the second, inactive position, the one or more accessories can be moved away from the user's face or ears when the circumstances do not require the additional protection or when the user desires to remove the protective helmet.

In several known protective helmets, the system for attaching the one more accessories has several disadvantages and requires improvement. In some examples, the protective helmet has a slot that is formed on its outer surface such that each accessory that is added to the helmet must be installed in the same slot. In other examples, the protective helmet has a through hole extending through the material of the hard shell, with each accessory being secured to the protective helmet by a fastener extending through the hole. In both of these arrangements, installation and removal of accessories are complicated because they require removing the protective helmet, thereby compromising the user's safety if such installation or removal is done in the field. In addition, existing arrangements for attaching accessories to the protective helmet generally include many different pieces that can be easily lost during installation and removal, which complicates the assembly process and increases the risk of incorrect assembly. Another disadvantage of existing attachment designs is that they can compromise electrical protection of the helmet depending on the location of the attachment mechanism.

Accordingly, there is a need in the art for an improved protective helmet that addresses certain drawbacks and deficiencies associated with existing protective helmets. For example, there is a need for an improved protective helmet that can be easily and effectively worn by the user in a variety of environments while allowing for easy attachment, use, and removal of a variety of accessories to the protective helmet at the same time without the need to remove the protective helmet from the user's head.

SUMMARY OF THE INVENTION

Generally, provided is a protective helmet with an accessory attachment rail that addresses and/or overcomes some or all of the drawbacks associated with existing protective helmets configured for attaching one or more accessories to the protective helmet. Preferably, provided is an improved protective helmet that can be easily and effectively worn by the user in a variety of environments while allowing for easy attachment, use, and removal of a variety of accessories to the protective helmet without the need to remove the protective helmet from the user's head.

In one preferred and non-limiting embodiment, provided is a protective helmet that may include: an outer shell configured for surrounding a head of a user and at least one accessory attachment rail connected to the outer shell. The accessory attachment rail may have a body having a front end, a rear end, and one or more slots between the front end and the rear end. Each of the one or more slots may be configured for removably receiving at least one helmet accessory. The accessory attachment rail may further have a locking mechanism associated with each of the one or more slots for automatically locking the at least one helmet accessory in the one or more slots upon insertion of the at least one helmet accessory within the one or more slots and for preventing removal of the at least one helmet accessory from the one or more slots until the locking mechanism is unlocked. The accessory attachment rail may further have at least one connection element for connecting the accessory attachment rail to the outer shell.

In another preferred and non-limiting embodiment, the locking mechanism may have a locking beam having a first end connected to at least a portion of the slot and a second free end movable relative to the first end in a direction toward an outer surface of the helmet when deflected by the at least one helmet accessory during insertion of the at least one helmet accessory into the one or more slots. The second free end of the locking beam may have a locking tab configured for engaging a corresponding locking slot on the at least one helmet accessory when the at least one helmet accessory is fully inserted into the one or more slots. The locking tab may have a tapered leading surface that is angled toward an open end of the one or more slots.

In another preferred and non-limiting embodiment, the at least one connection element may be a plurality of deflectable tabs spaced around an inner surface of the accessory attachment rail facing an outer surface of the outer shell. Each of the plurality of deflectable tabs may be configured for insertion into an opening formed on the outer shell. Each of the plurality of deflectable tabs may have a first end connected to the body of the accessory attachment rail and a second end protruding relative to the first end in a direction away from the inner surface and toward an outer surface of the outer shell. Each deflectable tab may have a lip for engaging a corresponding ledge on the outer shell.

In another preferred and non-limiting embodiment, the at least one connection element may be a plurality of annular snaps having a post defined by a pair of deflectable beams separated from each other by a space. Each of the plurality of annular snaps may be configured for insertion into an opening formed on the outer shell. Each of the deflectable beams may have a first end connected to the body of the accessory attachment rail and a second free end protruding from the body in a direction toward an outer surface of the outer shell.

In another preferred and non-limiting embodiment, the at least one connection element may be a projection that protrudes from an inner surface of the body in a direction toward an outer surface of the outer shell. The projection may be configured for insertion into a receiving slot protruding away from the outer surface of the outer shell. The at least one connection element may be a pair of tabs protruding from the front end and the rear end of the body. The at least one connection element may be at least one through hole extending through the body and configured to receive a fastener therethrough to connect the accessory attachment rail to the outer shell. Each of the one or more slots may have an open end configured for removably receiving the at least one helmet accessory, a closed end opposite the open end, a channel having a perimeter wall between the open end and the closed end.

In another preferred and non-limiting embodiment, the at least one helmet accessory may be at least one of a face shield or half-face goggle, earmuffs, and a headlamp. The at least one helmet accessory may be movable between a first or active position and a second or inactive position by pivoting relative to the accessory attachment rail about a pivot point.

In another preferred and non-limiting embodiment, an accessory attachment rail may have a body having a front end, a rear end, and one or more slots between the front end and the rear end. Each of the one or more slots may be configured for removably receiving at least one helmet accessory. The accessory attachment rail may further have a locking mechanism associated with each of the one or more slots for automatically locking the at least one helmet accessory in the one or more slots upon insertion of the at least one helmet accessory within the one or more slots and for preventing removal of the at least one helmet accessory from the one or more slots until the locking mechanism is unlocked. The accessory attachment rail may further have at least one connection element for connecting the accessory attachment rail to an outer shell of the helmet.

In another preferred and non-limiting embodiment, the locking mechanism may have a locking beam having a first end connected to at least a portion of the slot and a second free end movable relative to the first end in a direction toward an outer surface of the helmet when deflected by the at least one helmet accessory during insertion of the at least one helmet accessory into the one or more slots. The second free end of the locking beam may have a locking tab configured for engaging a corresponding locking slot on the at least one helmet accessory when the at least one helmet accessory is fully inserted into the one or more slots. The locking tab may have a tapered leading surface that is angled toward an open end of the one or more slots.

In another preferred and non-limiting embodiment, the at least one connection element may be a plurality of deflectable tabs spaced around an inner surface of the accessory attachment rail facing an outer surface of the outer shell. Each of the plurality of deflectable tabs may be configured for insertion into an opening formed on the outer shell. Each of the plurality of deflectable tabs may have a first end connected to the body of the accessory attachment rail and a second end protruding relative to the first end in a direction away from the inner surface and toward an outer surface of the outer shell. Each deflectable tab may have a lip for engaging a corresponding ledge on the outer shell.

Further non-limiting embodiments or aspects will now be set forth in the following numbered clauses.

Clause 1. A protective helmet comprising: an outer shell configured for surrounding a head of a user; at least one accessory attachment rail connected to the outer shell, the accessory attachment rail comprising: a body having a front end, a rear end, and one or more slots between the front end and the rear end, each of the one or more slots configured for removably receiving at least one helmet accessory; a locking mechanism associated with each of the one or more slots for automatically locking the at least one helmet accessory in the one or more slots upon insertion of the at least one helmet accessory within the one or more slots and for preventing removal of the at least one helmet accessory from the one or more slots until the locking mechanism is unlocked; and at least one connection element for connecting the accessory attachment rail to the outer shell.

Clause 2. The protective helmet of clause 1, wherein the locking mechanism comprises a locking beam having a first end connected to at least a portion of the slot and a second free end movable relative to the first end in a direction toward an outer surface of the helmet when deflected by the at least one helmet accessory during insertion of the at least one helmet accessory into the one or more slots.

Clause 3. The protective helmet of clause 1 or clause 2, wherein the second free end of the locking beam has a locking tab configured for engaging a corresponding locking slot on the at least one helmet accessory when the at least one helmet accessory is fully inserted into the one or more slots.

Clause 4. The protective helmet of any of clauses 1-3, wherein the locking tab has a tapered leading surface that is angled toward an open end of the one or more slots.

Clause 5. The protective helmet of any of clauses 1-4, wherein the at least one connection element is a plurality of deflectable tabs spaced around an inner surface of the accessory attachment rail facing an outer surface of the outer shell, each of the plurality of deflectable tabs configured for insertion into an opening formed on the outer shell.

Clause 6. The protective helmet of any of clauses 1-5, wherein each of the plurality of deflectable tabs has a first end connected to the body of the accessory attachment rail and a second end protruding relative to the first end in a direction away from the inner surface and toward an outer surface of the outer shell.

Clause 7. The protective helmet of any of clauses 1-6, wherein each deflectable tab has a lip for engaging a corresponding ledge on the outer shell.

Clause 8. The protective helmet of any of clauses 1-7, wherein the at least one connection element is a plurality of annular snaps having a post defined by a pair of deflectable beams separated from each other by a space, each of the plurality of annular snaps configured for insertion into an opening formed on the outer shell.

Clause 9. The protective helmet of any of clauses 1-8, wherein each of the deflectable beams has a first end connected to the body of the accessory attachment rail and a second free end protruding from the body in a direction toward an outer surface of the outer shell.

Clause 10. The protective helmet of any of clauses 1-9, wherein the at least one connection element is a projection that protrudes from an inner surface of the body in a direction toward an outer surface of the outer shell, the projection being configured for insertion into a receiving slot protruding away from the outer surface of the outer shell.

Clause 11. The protective helmet of any of clauses 1-10, wherein the at least one connection element is a pair of tabs protruding from the front end and the rear end of the body.

Clause 12. The protective helmet of any of clauses 1-11, wherein the at least one connection element is at least one through hole extending through the body and configured to receive a fastener therethrough to connect the accessory attachment rail to the outer shell.

Clause 13. The protective helmet of any of clauses 1-12, wherein each of the one or more slots has an open end configured for removably receiving the at least one helmet accessory, a closed end opposite the open end, a channel having a perimeter wall between the open end and the closed end.

Clause 14. The protective helmet of any of clauses 1-13, further comprising the at least one helmet accessory.

Clause 15. The protective helmet of any of clauses 1-14, wherein the at least one helmet accessory is at least one of a face shield or half-face goggles, earmuffs, and a headlamp.

Clause 16. The protective helmet of any of clauses 1-15, wherein the at least one helmet accessory is movable between a first or active position and a second or inactive position by pivoting relative to the accessory attachment rail about a pivot point.

Clause 17. An accessory attachment rail for a protective helmet, the accessory attachment rail comprising: a body having a front end, a rear end, and one or more slots between the front end and the rear end, each of the one or more slots configured for removably receiving at least one helmet accessory; a locking mechanism associated with each of the one or more slots for automatically locking the at least one helmet accessory in the one or more slots upon insertion of the at least one helmet accessory within the one or more slots and for preventing removal of the at least one helmet accessory from the one or more slots until the locking mechanism is unlocked; and at least one connection element for connecting the accessory attachment rail to the outer shell.

Clause 18. The accessory attachment rail of clause 17, wherein the locking mechanism comprises a locking beam having a first end connected to at least a portion of the slot and a second free end movable relative to the first end in a direction toward an outer surface of the helmet when deflected by the at least one helmet accessory during insertion of the at least one helmet accessory into the one or more slots.

Clause 19. The accessory attachment rail of clause 17 or 18, wherein the second free end of the locking beam has a locking tab configured for engaging a corresponding locking slot on the at least one helmet accessory when the at least one helmet accessory is fully inserted into the one or more slots.

Clause 20. The accessory attachment rail of any of clauses 17-19, wherein the at least one connection element is a plurality of deflectable tabs spaced around an inner surface of the accessory attachment rail facing an outer surface of the outer shell, each of the plurality of deflectable tabs configured for insertion into an opening formed on the outer shell.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

BRIEF DESCRIPTION OF THE DRAWINGS

In FIGS. 1-16, like characters refer to the same components and elements, as the case may be, unless otherwise stated.

DETAILED DESCRIPTION OF THE PREFERRED EMBODIMENTS

Figure 1A:
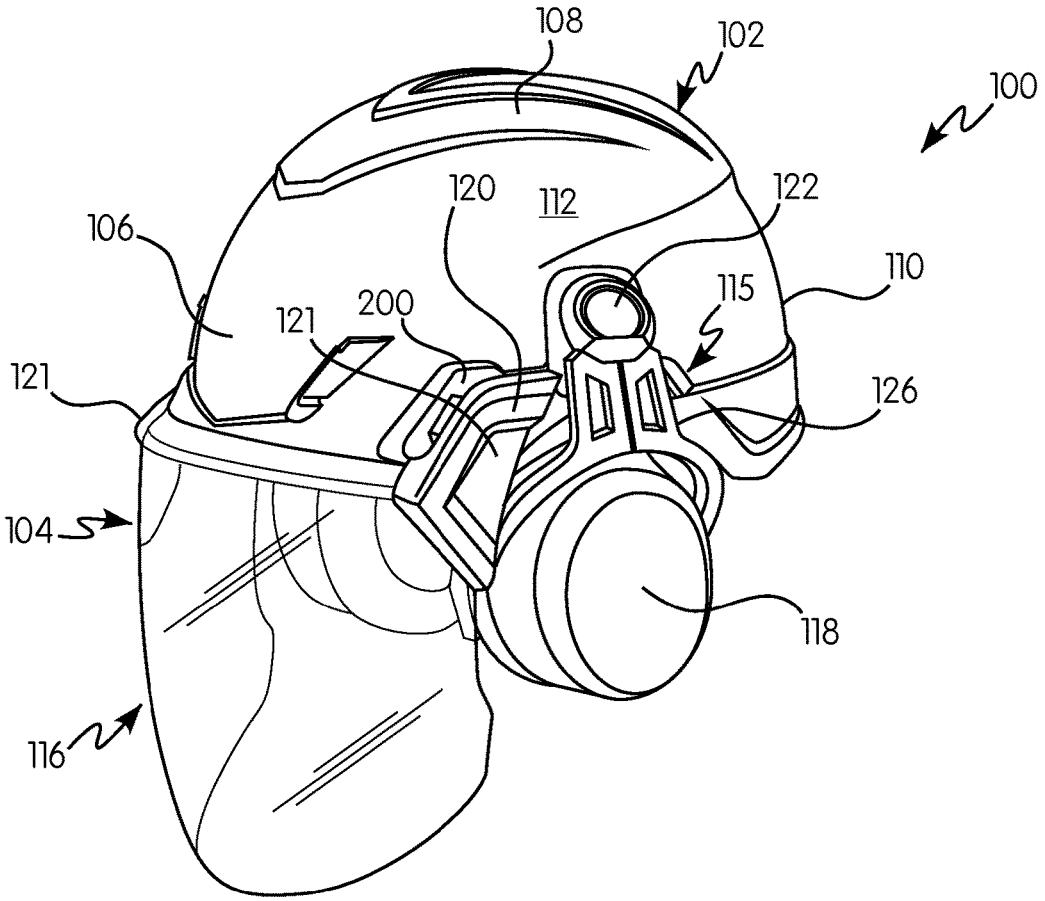
FIG. 1A is a side perspective view of a protective helmet according to the principles of the present invention, with a plurality of accessories shown in a first or active position.

As used herein, the singular form of "a", "an", and "the" include plural referents unless the context clearly dictates otherwise.

Spatial or directional terms, such as "left", "right", "inner", "outer", "above", "below", and the like, relate to the invention as shown in the drawing figures and are not to be considered as limiting as the invention can assume various alternative orientations.

All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

The term "at least" is synonymous with "greater than or equal to".

The term "not greater than" is synonymous with "less than or equal to".

As used herein, "at least one of" is synonymous with "one or more of". For example, the phrase "at least one of A, B, and C" means any one of A, B, or C, or any combination of any two or more of A, B, or C. For example, "at least one of A, B, and C" includes A alone; or B alone; or C alone; or A and B; or A and C; or B and C; or all of A, B, and C.

The term "adjacent" means proximate to but not in direct contact with.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

Figure 1B:
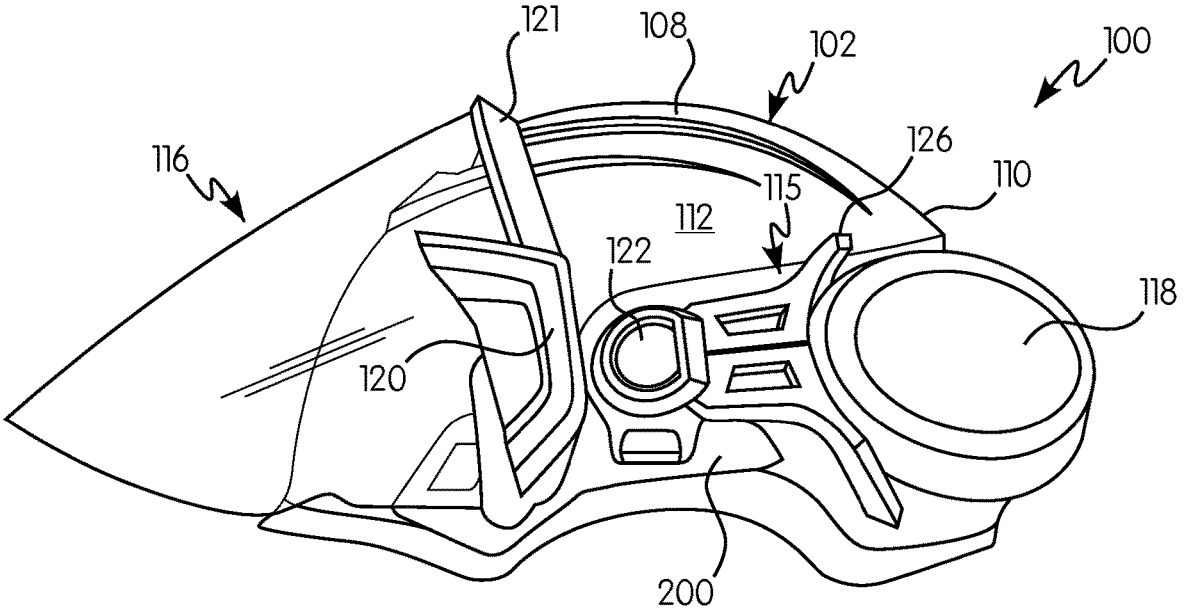
FIG. 1B is a side perspective view of the protective helmet of FIG. 1A with the plurality of accessories shown in a second or inactive position.

With reference to FIGS. 1A-1B, provided is a protective helmet 100 (hereinafter referred to as "helmet 100") having a rigid outer shell 102 configured to surround the head of a user. In some non-limiting embodiments or aspects, the rigid outer shell 102 may be constructed from a composite material. The shell 102 has a generally hemi-spherical form and has a facial opening 104 at a front end for accommodating the user's face. The shell 102 includes a front portion 106 situated above the facial opening 104, an upper portion 108, and a rear portion 110 extending from the upper portion 108 to the nape of the user's neck. A pair of lateral portions 112 extend from the upper portion 108 on each side of the facial opening 104.

With continued reference to FIGS. 1A-1B, the helmet 100 has an accessory attachment rail 200 attached to each lateral portion 112, such as at a connection area 114 of each lateral portion 112. The accessory attachment rail 200 is configured for removably receiving at least one helmet accessory 115, such as a face shield 116 or half-face goggles, earmuffs 118, a headlamp, or any other accessory. The at least one helmet accessory 115 is configured to increase the functionality of the helmet 100, such as by providing additional protection to the user or providing additional capability to the helmet 100.

As described herein, the face shield 116 and the earmuffs 118 are removably attachable to the helmet 100 by way of the accessory attachment rail 200. While FIGS. 1A-1B illustrate a pair of helmet accessories 115 attached to the helmet 100 by way of the accessory attachment rail 200, other embodiments or aspects of the accessory attachment rail 200 may be configured for attaching more than two helmet accessories 115 to the helmet 100.

With continued reference to FIGS. 1A-1B, at least one helmet accessory 115 may be movable between a first or active position, and a second or inactive position. As shown in FIG. 1A, the face shield 116 is configured to extend over the facial opening 104 of the helmet 100 in order to protect the user's face. The face shield 116 is desirably constructed from a transparent material such that the user's vision is not impaired by the presence of the face shield 116 in front of the user's face. The face shield 116 is movable from the first or active position (FIG. 1A) to a second or inactive position (FIG. 1B), such as by a pivoting movement about a first pivot point 119. In some non-limiting embodiments or aspects, the face shield 116 is movable by grasping at least a portion of the face shield 116 and pivoting the face shield 116 relative to the helmet 100 such that the face shield 116 is moved away from covering the facial opening 104. In the second or inactive position, the face shield 116 may extend over at least a part of the front portion 106 and the upper portion 108 of the helmet 100. The face shield 116 has a pivoting connection with the accessory attachment rail 200 to allow movement of the face shield 116 from the first or active position to the second or inactive position via a pivoting or rotating movement about the first pivot point 119.

With continued reference to FIGS. 1A-1B, each of the earmuffs 118 is configured to extend over the user's ears from the lateral portions 112 of the helmet 100 in order to protect the user's ears from ambient noise. The earmuffs 118 desirably have noise suppressing or cancelling properties to reduce or eliminate ambient noise from harming the user's hearing. Each of the earmuffs 118 is movable from the first or active position (FIG. 1A) to a second or inactive position (FIG. 1B), such as a pivoting movement about a second pivot point 124. In some non-limiting embodiments or aspects, each of the earmuffs 118 is movable by grasping at least a portion of the earmuff 118 and pivoting the earmuffs 118 relative to the helmet 100 such that the earmuffs 118 are moved away from covering the user's ears. In the second or inactive position, the earmuffs 118 may extend over at least a part of the lateral portions 112 and the rear portion 110 of the helmet 100. The earmuffs 118 have a frame 126 having a pivoting connection with the accessory attachment rail 200 to allow movement of the earmuffs 118 from the first or active position to the second or inactive position via a pivoting or rotating movement about the second pivot point 124.

Figure 2:
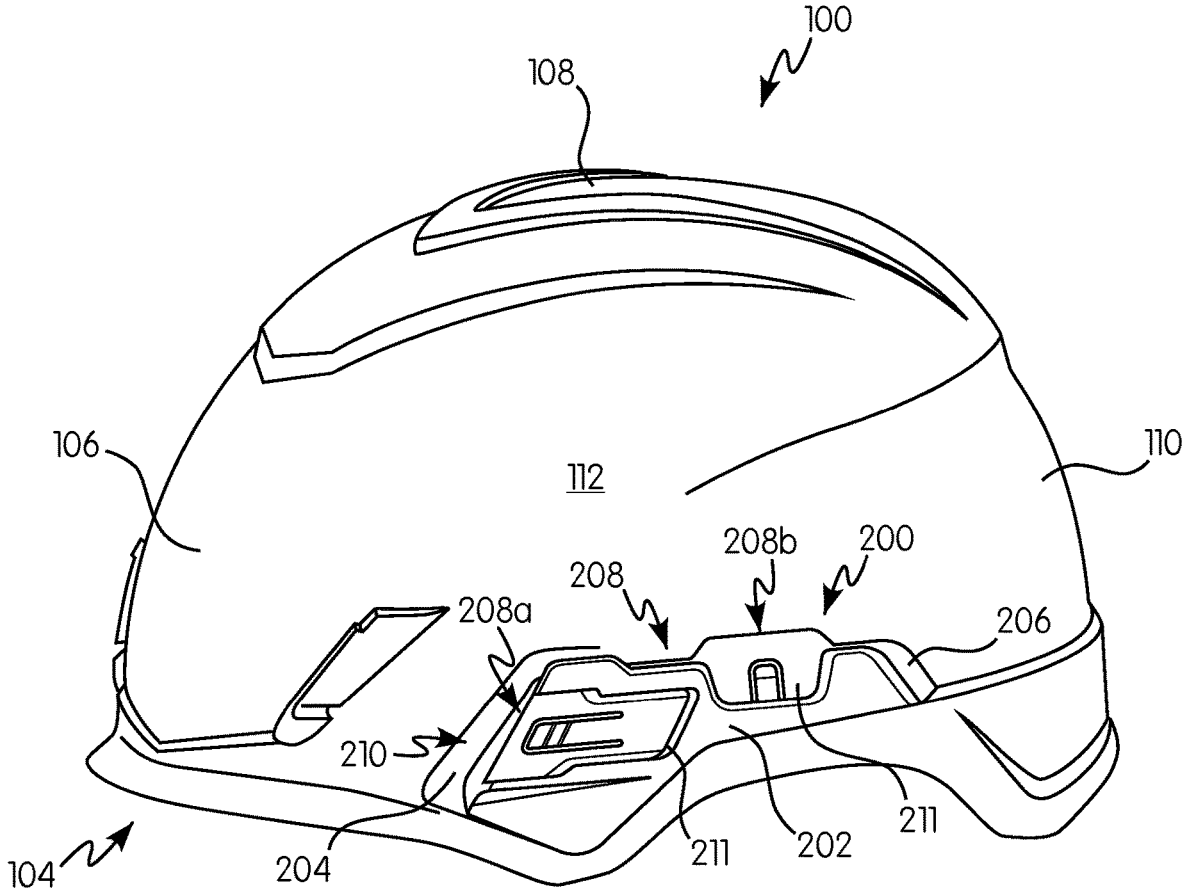
FIG. 2 is a side perspective view of the protective helmet of FIG. 1A shown without the plurality of accessories.

With reference to FIG. 2, the helmet 100 is illustrated without the helmet accessories 115 shown in FIGS. 1A-1B. The accessory attachment rail 200 remains attached to the helmet 100 after removal of the helmet accessories 115 to allow a subsequent reattachment of the helmet accessories 115. In some non-limiting embodiments or aspects, the accessory attachment rail 200 may be non-removably attached to the helmet 100, such as by way of one or more attachment mechanisms discussed herein. In other non-limiting embodiments or aspects, the accessory attachment rail 200 may be monolithically formed with the helmet 100, such as by molding or co-molding with the helmet 100. In further non-limiting embodiments or aspects, the accessory attachment rail 200 may be removably attachable to the helmet 100, such as by way of one or more connection elements discussed herein.

With continued reference to FIG. 2, the accessory attachment rail 200 has a body 202 having a front end 204, a rear end 206, and one or more slots 208 between the front end 204 and the rear end 206. Each of the one or more slots 208 has an open end 210 configured for removably receiving one helmet accessory 115, such as the face shield 116 or the earmuffs 118, and a closed end 211 opposite the open end 210. The closed end 211 defines a stop surface for preventing further insertion of the helmet accessory 115 into the slot 208. As shown in FIG. 2, the accessory attachment rail 200 may have a pair of slots 208 configured for receiving a pair of helmet accessories 115. In this manner, a first helmet accessory 115, such as the face shield 116 (shown in FIGS. 1A-1B), can be attached to a first slot 208a independently of a second helmet accessory 115, such as the earmuffs 118 (shown in FIGS. 1A-1B), which may be attached to a second slot 208b of the accessory attachment rail 200.

The open end 210 of at least one slot 208 may be arranged such that it faces the front portion 106 or the upper portion 108 of the helmet 100. In this manner, the slot 208 allows for attachment of the helmet accessory 115 by movement in a direction from the front portion 106 of the helmet to the rear portion 110 of the helmet 100 (front opening slot 208), or by movement in a direction from the upper portion 108 toward a bottom end of the helmet 100 (upward opening slot 208). In other non-limiting embodiments or aspects, the open end 210 of at least one slot 208 may be arranged such that it faces the rear portion 110 of the helmet 100 or the bottom end of the helmet 100 to allow for attachment of the helmet accessory 115 by movement in a direction from the rear portion 110 of the helmet to the front portion 106 of the helmet 100 (rear opening slot 208) or by movement in a direction toward the upper portion 108 of the helmet 100 (bottom opening slot 208).

Figure 3A:
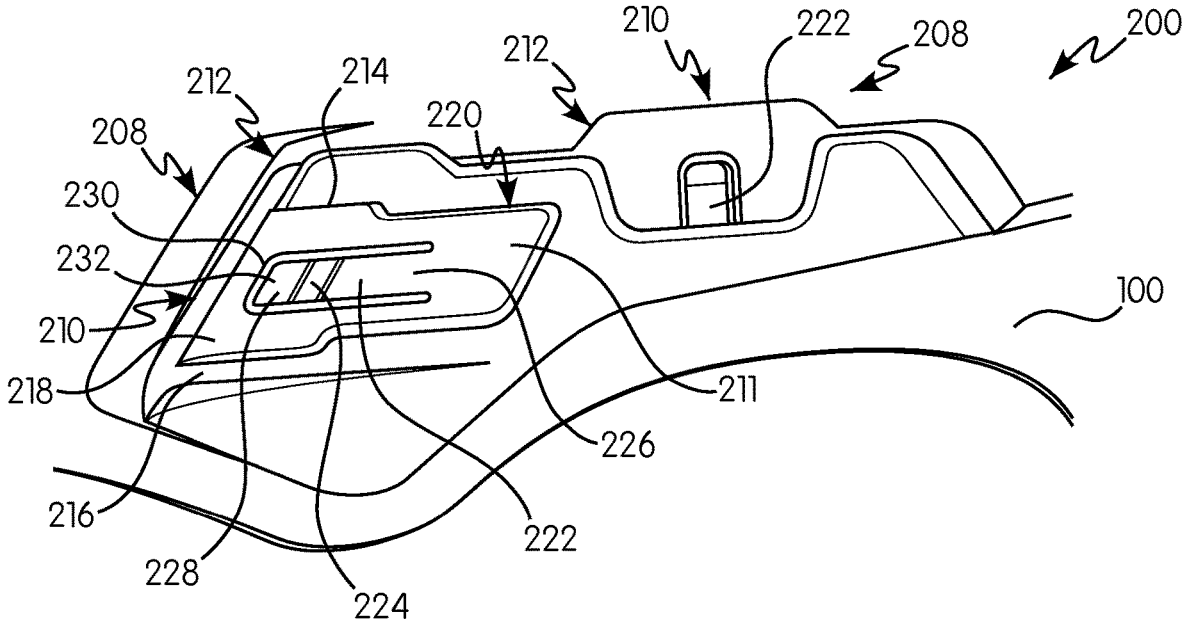
FIG. 3A is a detailed front perspective view of an accessory attachment rail of the protective helmet shown in FIG. 2A.

With reference to FIG. 3A, each slot 208 has a receiving area 212 configured for receiving a corresponding connector on the helmet accessory 115 (shown in FIGS. 1A-1B). The receiving area 212 is defined by a channel 214 having a perimeter sidewall 216. In some non-limiting embodiments or aspects, a width of the channel 214 may narrow in a direction from the open end 210 toward the closed end 211 of the slot 208. In other non-limiting embodiments or aspects, the width of the channel 214 may be substantially uniform throughout its length in a direction from the open end 210 toward the closed end 211 of the slot 208. In some non-limiting embodiments or aspects, the channel 214 may have a closed wall 218 on a side immediately adjacent to the helmet 100 and an open side 220 on a side opposite the closed wall 218. The closed wall 218 is offset from the open side 220 by a width of the perimeter sidewall 216. In some non-limiting embodiments or aspects, the channel 214 may be substantially U-shaped.

Figure 3B:
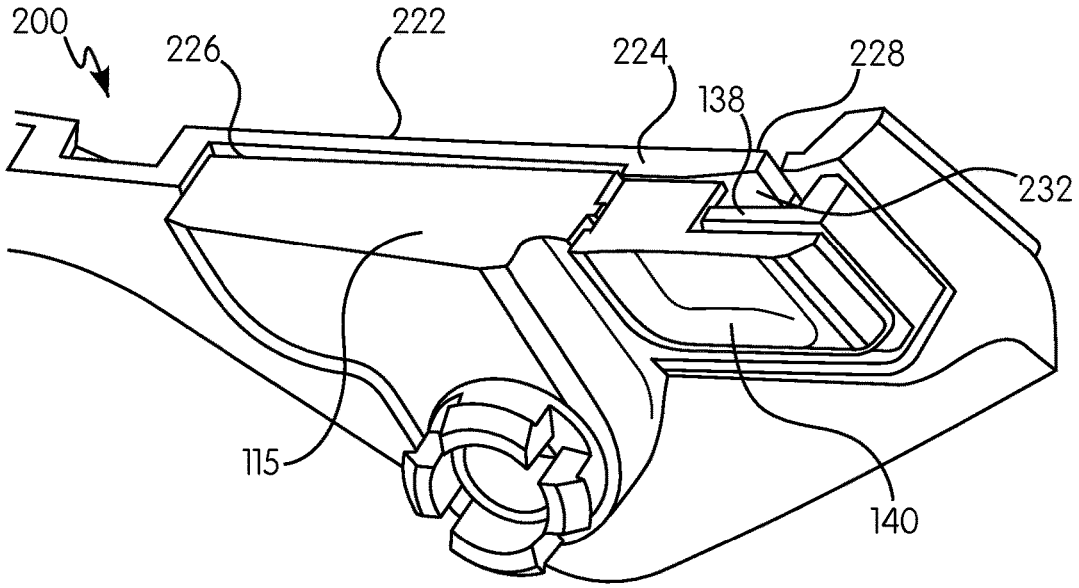
FIG. 3B is a detailed cross-sectional view of a helmet accessory connected to the accessory attachment rail shown in FIG. 3A.

With continued reference to FIGS. 3A-3B, each slot 208 has a locking mechanism for automatically locking the helmet accessory 115 within the slot 208 upon insertion of the helmet accessory 115 within the slot 208 and for preventing removal of the helmet accessory 115 from the slot 208 until the locking mechanism is unlocked. In some non-limiting embodiments or aspects, the locking mechanism may be a locking beam 222 having a locking tab 224 configured for engaging a corresponding locking slot 138 on the helmet accessory 115 (shown in FIG. 3B). The locking beam 222 may have a cantilevered arrangement with a first end 226 connected to the closed wall 218 of the slot 208 and a free second end 228 opposite the first end 226. The second end 228 of the locking beam 222 is deflectable relative to the first end 226 in a direction toward the closed wall 218 when urged by at least a portion of the helmet accessory 115 during insertion of the helmet accessory 115 into the slot 208. In this manner, the locking beam 222 is deflectable from a first or initial position toward a second or deflected position to provide a clearance space for the helmet accessory 115 to be inserted into the slot 208. A recess 230 may be provided in the closed wall 218 of the slot 208 to allow deflection of the locking beam 222 toward the second or deflected position. After insertion of the helmet accessory 115 into the slot 208, the locking beam 222 deflects back from the second or deflected position toward the first or initial position such that the locking beam 222 is captured within the locking slot 138 on the helmet accessory 115. In some non-limiting embodiments or aspects, the locking beam 222 may be deflected from the second or deflected position toward an intermediate position when fully engaged with the helmet accessory 115. In some non-limiting embodiments or aspects, the locking beam 222 may be formed on the helmet accessory 115.

With continued reference to FIGS. 3A-3B, the locking tab 224 of the locking beam 222 has a tapered leading surface 232 that is angled toward the open end 210 of the slot 208. The tapered leading surface 232 is the initial contact surface of the locking beam 222 that is engaged by the helmet accessory 115 as the helmet accessory 115 is inserted into the slot 208. The tapered leading surface 232 is configured to facilitate deflection of the second end 228 of the locking beam 222 during insertion of the helmet accessory 115. A release button 140 on the helmet accessory 115 is configured for contacting the locking tab 224 and deflecting the locking tab 224 with the pressing of the release button 140 in a direction toward the helmet 100. Such movement of the release button 140 deflects the second end 228 of the locking beam 222 such that the locking tab 224 disengages from the locking slot 138 to allow the helmet accessory 115 to be removed from the slot 208 by pulling the helmet accessory 115 through the open end 210 of the slot 208.

Figure 3C:
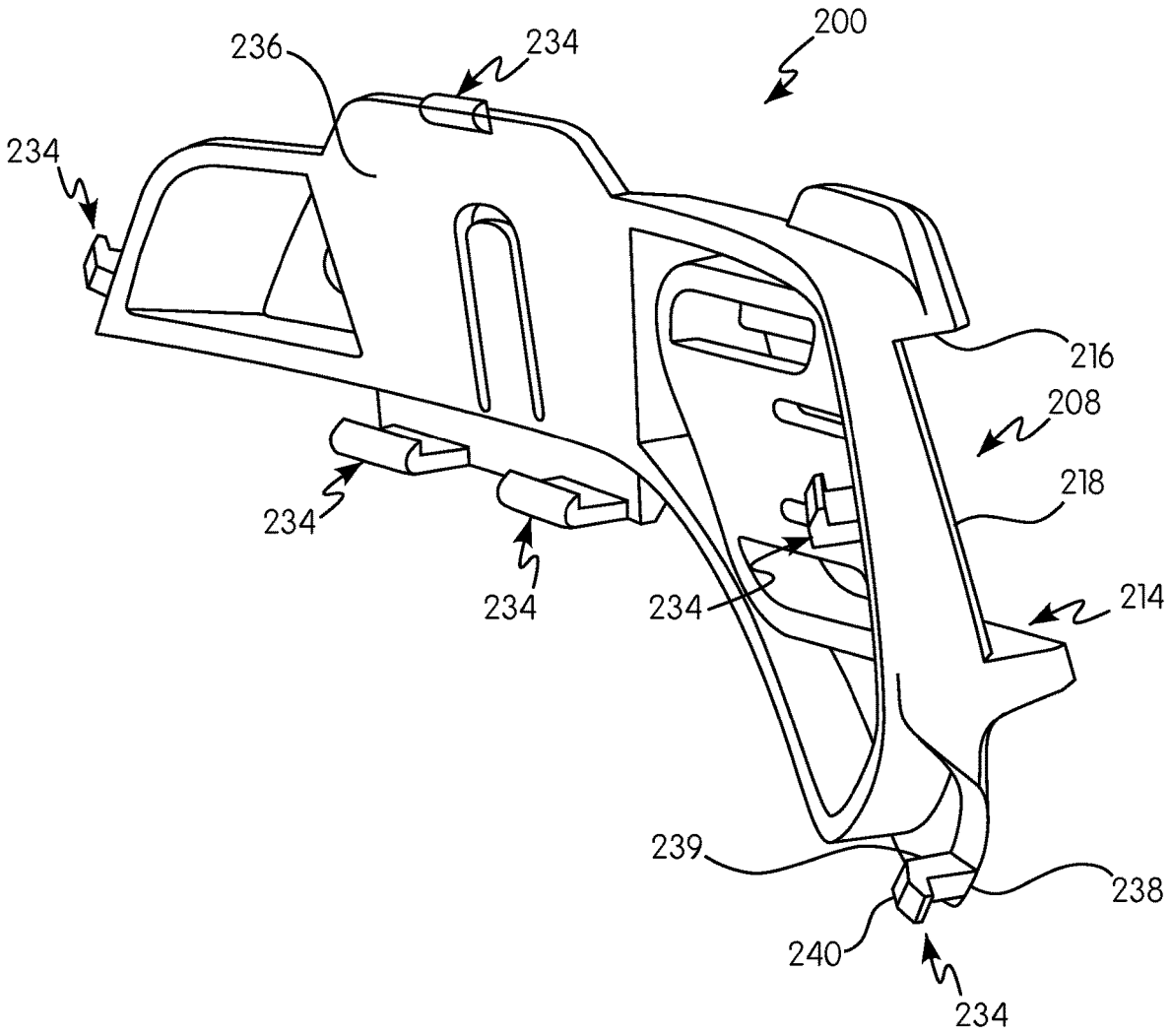
FIG. 3C is a detailed rear perspective view of the accessory attachment rail shown in FIG. 3A.

With reference to FIG. 3C, the accessory attachment rail 200 has one or more connection elements 234 configured for connecting the accessory attachment rail 200 to the helmet 100. In some non-limiting embodiments or aspects, the one or more connection elements 234 may be configured for non-removably connecting the accessory attachment rail 200 to the helmet 100, such as during manufacture of the helmet 100. In other non-limiting embodiments or aspects, the one or more connection elements 234 may be configured for removably connecting the accessory attachment rail 200 to the helmet 100 to allow free installation and removal of the accessory attachment rail 200 to and from the helmet 100.

With continued reference to FIG. 3C, in some non-limiting embodiments or aspects, the one or more connection elements 234 may be a plurality of deflectable tabs spaced around an inner surface 236 of the accessory attachment rail 200 facing the outer surface of the helmet 100. Each connection element 234 may have a first end 238 connected to the body 202 of the accessory attachment rail 200 and a second end 239 protruding relative to the first end 238 in a direction away from the inner surface 236 and toward the outer surface of the helmet. Each connection element 234 may have a locking lip 240 at the second end 239 configured for engaging a corresponding ledge on the helmet 100. For example, as shown in FIG. 4B, the helmet 100 may have one or more openings 132 extending through the outer shell 102 in the area of the lateral portion 112 where the accessory attachment rail 200 is to be attached. The one or more openings 132 are configured to receive the one or more connection elements 234 of the accessory attachment rail 200. The second end 238 of each connection element 234 is deflectable relative to the first end 236 during contact with an outer surface of the helmet 100 when during installation of the accessory attachment rail 200 on the helmet 100. In this manner, the connection element 234 is deflectable from a first or initial position toward a second or deflected position to provide a clearance space for the connection element 234 to be inserted into the opening 132 on the helmet 100. After insertion of the connection element 234 into the opening 132, the second end 238 of the connection element 234 deflects back from the second or deflected position toward the first or initial position to lock the connection element 234 with the lip 136 of the opening 132.

Figure 4A:
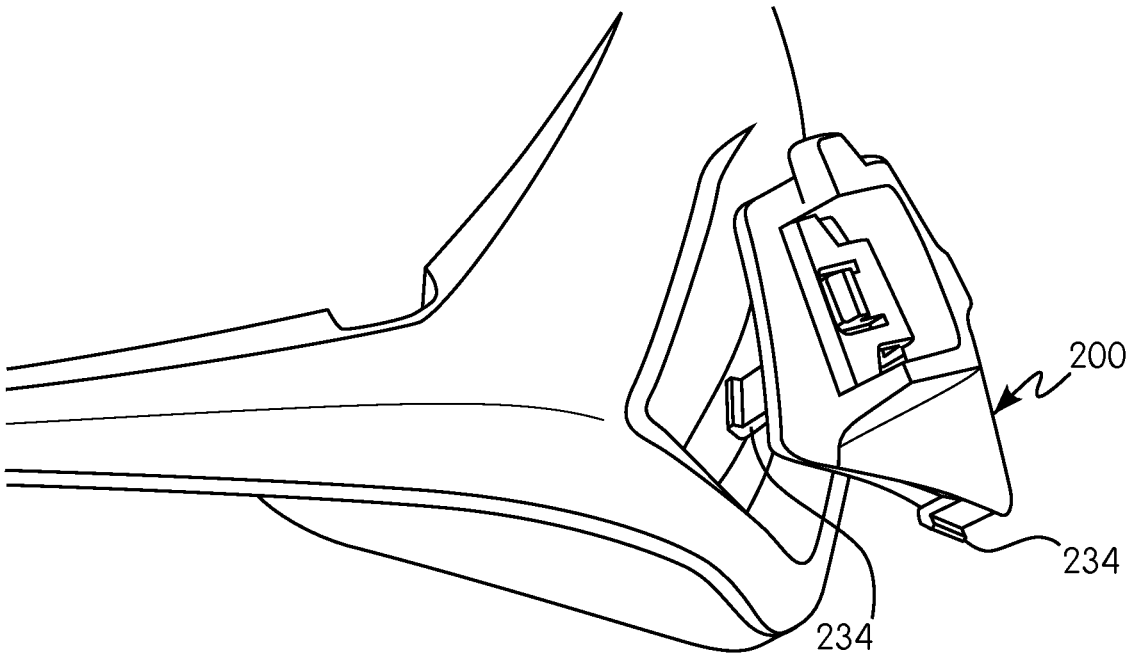
FIG. 4A is a detailed front perspective view of the accessory attachment rail shown during attachment to the protective helmet.
Figure 4B:
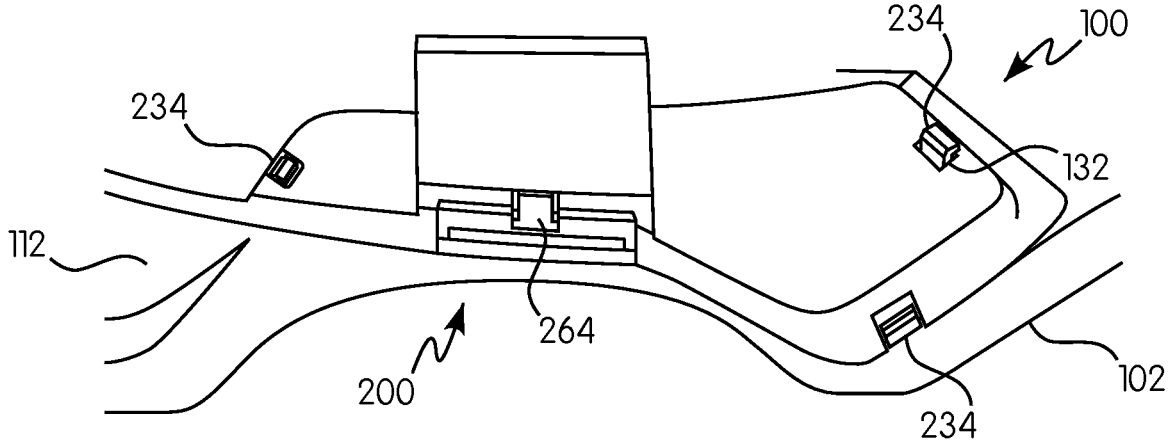
FIG. 4B is a detailed view of an inside portion of the helmet showing the accessory attachment rail attached to the helmet.

With reference to FIG. 4A, the accessory attachment rail 200 may be connected to the helmet 100 by inserting a first portion of the one or more connection elements 234 on an upper portion of the accessory attachment rail 200 into the corresponding openings 132 on the helmet 100 and rotating a lower portion of the accessory attachment rail 200 in a direction toward the helmet 100 to connect a second portion of the one or more connection elements 234 on the lower portion of the accessory attachment rail 200 with the corresponding openings 132 on the helmet 100. As described herein, the one or more connection elements 234 may be configured for non-removably connecting the accessory attachment rail 200 to the helmet 100 to prevent removal of the accessory attachment rail 200 from the helmet 100. In other non-limiting embodiments or aspects, the one or more connection elements 234 may be configured for removably connecting the accessory attachment rail 200 to the helmet 100 to allow free installation and removal of the accessory attachment rail 200 to and from the helmet 100.

Figure 5A:
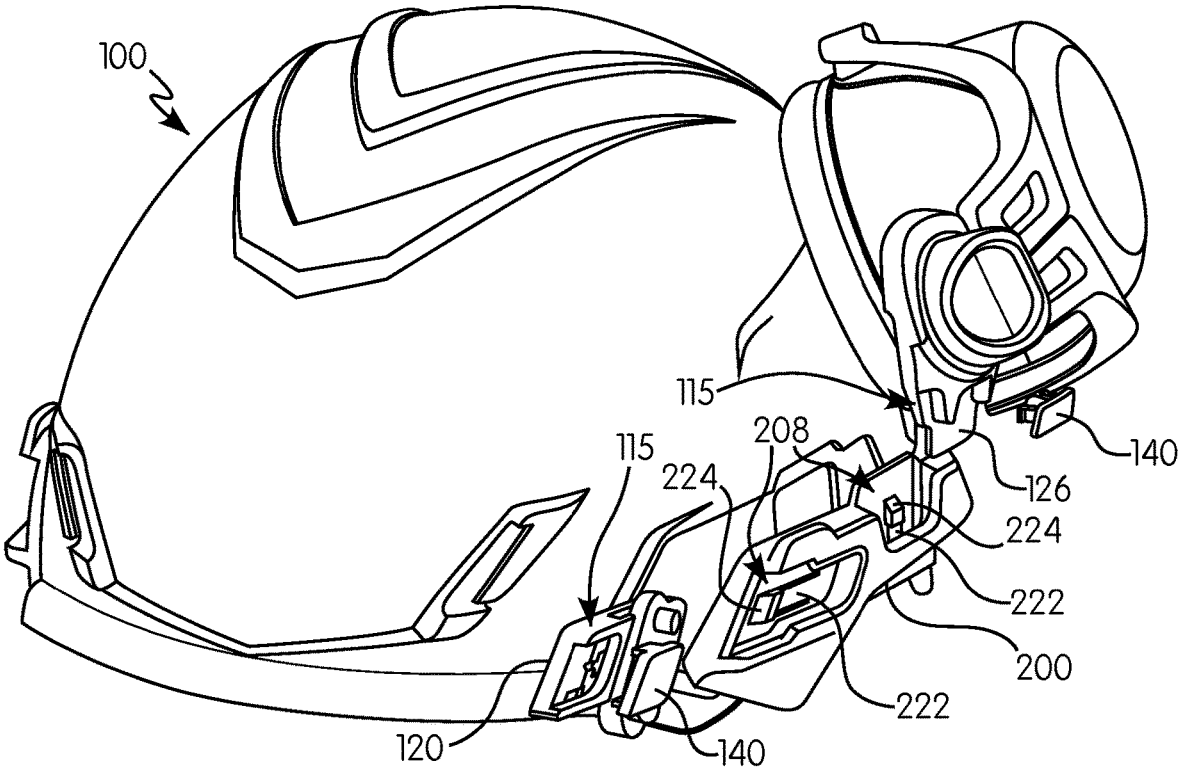
FIG. 5A is an exploded front perspective view of the protective helmet shown in FIG. 1A showing a connection mechanism of an accessory attachment rail.
Figure 5B:
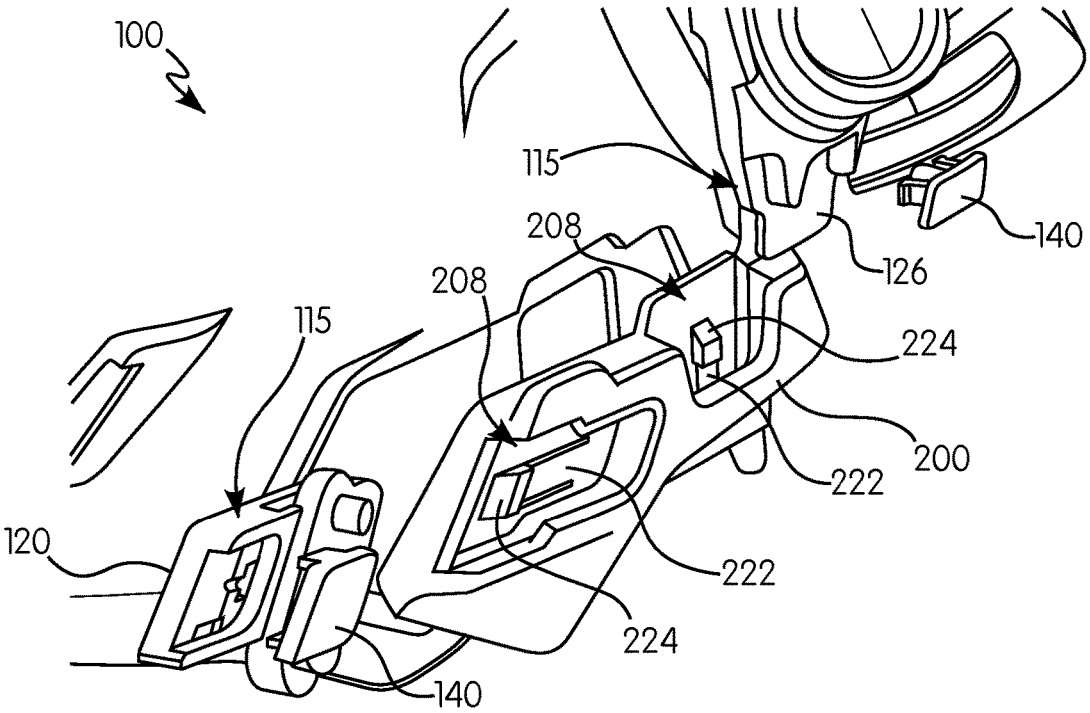
FIG. 5B is a detailed view of the connection mechanism of the accessory attachment rail shown in FIG. 5A.

With reference to FIGS. 5A-5B, frames 120, 126 of various helmet accessories 115 are shown prior to connection with the slot 208 of the accessory attachment rail 200. As shown in FIG. 5B, each frame 120, 126 is shaped such that it corresponds to the shape of the slot 208. An inner side of each frame 120, 126 facing the outer surface of the helmet 100 has a lip (not shown) configured for engaging the locking tab 224 of the locking beam 222 when the frame 120, 126 is fully inserted into the corresponding slot 208. A release button 140 on each frame 120, 126 is configured for contacting the locking tab 224 and deflecting the locking tab 224 with the pressing of the release button 140 in a direction toward the helmet 100. Such movement of the release button 140 deflects the second end 228 of the locking beam 222 such that the locking tab 224 disengages from the lip on the frame 120, 126 to allow the frame 120, 126 to be removed from the slot 208 by pulling the frame 120, 126 through the open end 210 of the slot 208.

Figure 6:
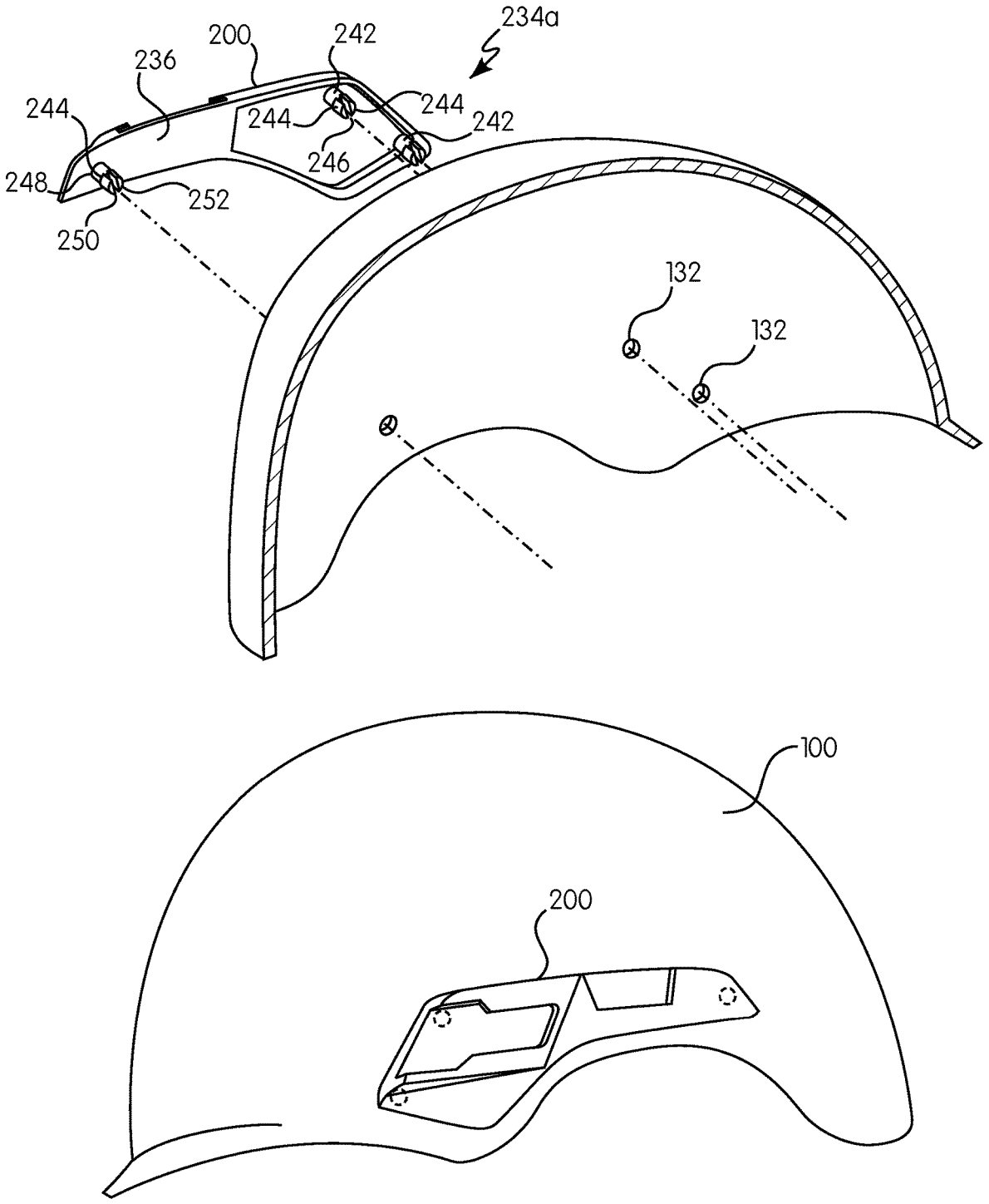
FIG. 6 is a perspective view of a protective helmet and an accessory attachment rail in accordance with another non-limiting embodiment or aspect.

With reference to FIG. 6, one or more connection elements 234*a* is shown in accordance with another embodiment or aspect. Instead of being a deflectable cantilever beam arrangement, such as shown in FIGS. 4A-4B, the connection elements 234*a* are configured as annular snaps having a post 242 defined by a pair of beams 244 separated from one another by a space 246. A first end 248 of each beam 244 is connected to the inner surface 236 of the accessory attachment rail 200 while a second end 250 of the beam 244 protrudes from the first end 248 in a direction toward the helmet 100. The second end 250 has a bulbous head 252. The second ends 250 of each of the beams 244 are configured to deflect toward each other when the bulbous head 252 is inserted through the corresponding opening 132 on the helmet 100. After the bulbous head 252 clears the opening 132, the second ends 250 of each of the beams 244 are configured to deflect away from each other to prevent removal of the accessory attachment rail 200 from the helmet 100. The one or more connection elements 234 may be configured for removably or non-removably connecting the accessory attachment rail 200 to the helmet 100, as described herein.

Figure 7:
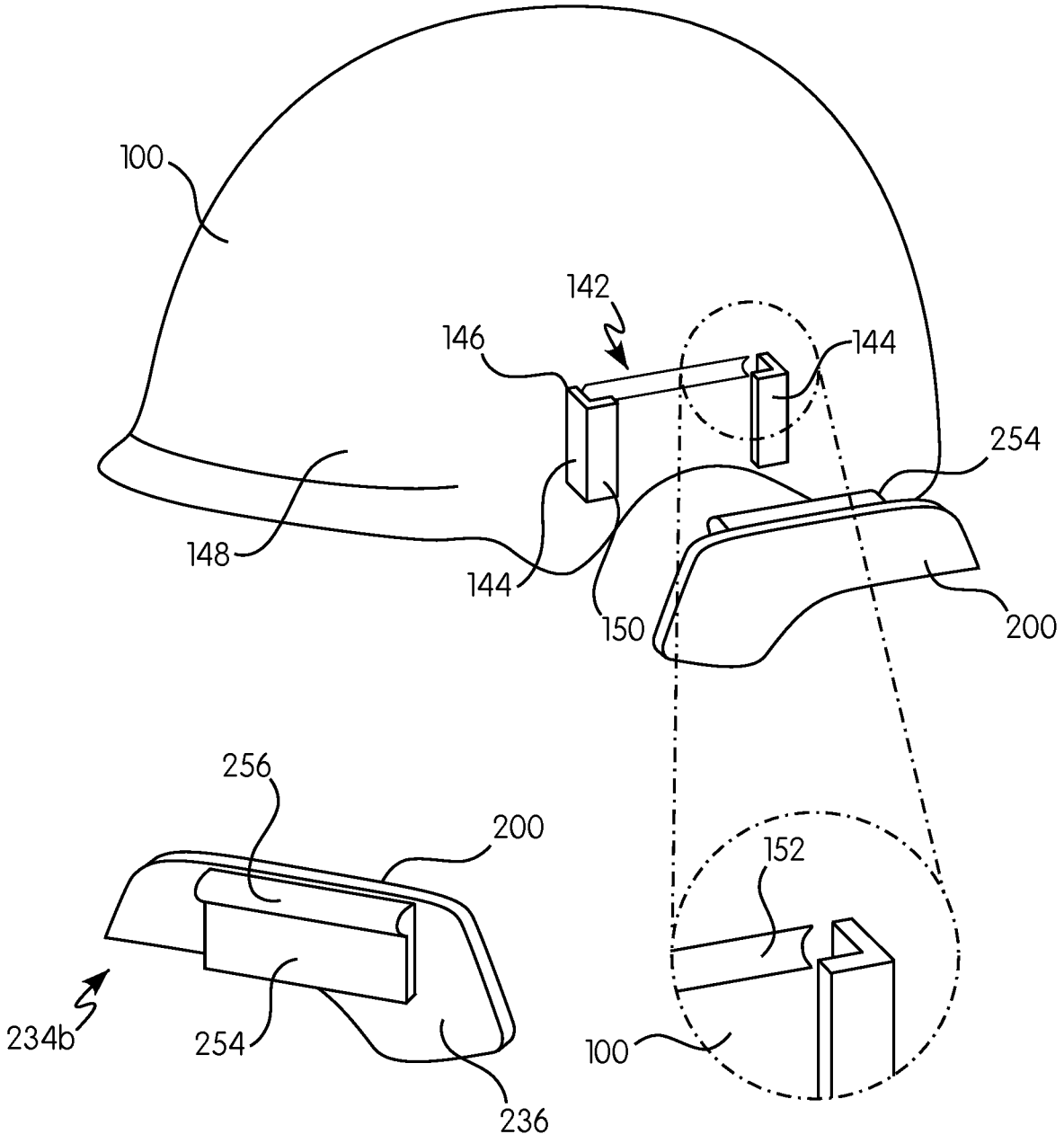
FIG. 7 is a perspective view of a protective helmet and an accessory attachment rail in accordance with another non-limiting embodiment or aspect.

With reference to FIG. 7, one or more connection elements 234*b* is shown in accordance with another embodiment or aspect. The one or more connection elements 234*b* may be formed as a projection 254 that protrudes from the inner surface 236 of the accessory attachment rail 200. The projection 254 may be configured for being received within a receiving slot 142 on the helmet 100. In some non-limiting embodiments or aspects, the receiving slot 142 may be defined as a space between a pair of spaced apart arms 144 having a first end 146 connected to an outer surface 148 of the helmet 100 and a second end 150 protruding relative to the first end 146 in a direction away from the outer surface 148 of the helmet 100. The arms 144 are spaced apart from each other such that the projection 254 of the accessory attachment rail 200 can be inserted therebetween to connect the accessory attachment rail 200 to the helmet 100. In some non-limiting embodiments or aspects, a recess 152 is recessed into the outer surface 148 of the helmet 100 and is configured to receive a key 256 on the projection 254 to prevent removal of the accessory attachment rail 200 from the receiving slot 142. In some non-limiting embodiments or aspects, the projection 254 and the receiving slot 142 may be reversed such that the projection 254 is formed on the helmet 100, while the receiving slot 142 is formed on the accessory attachment rail 200.

Figure 8:
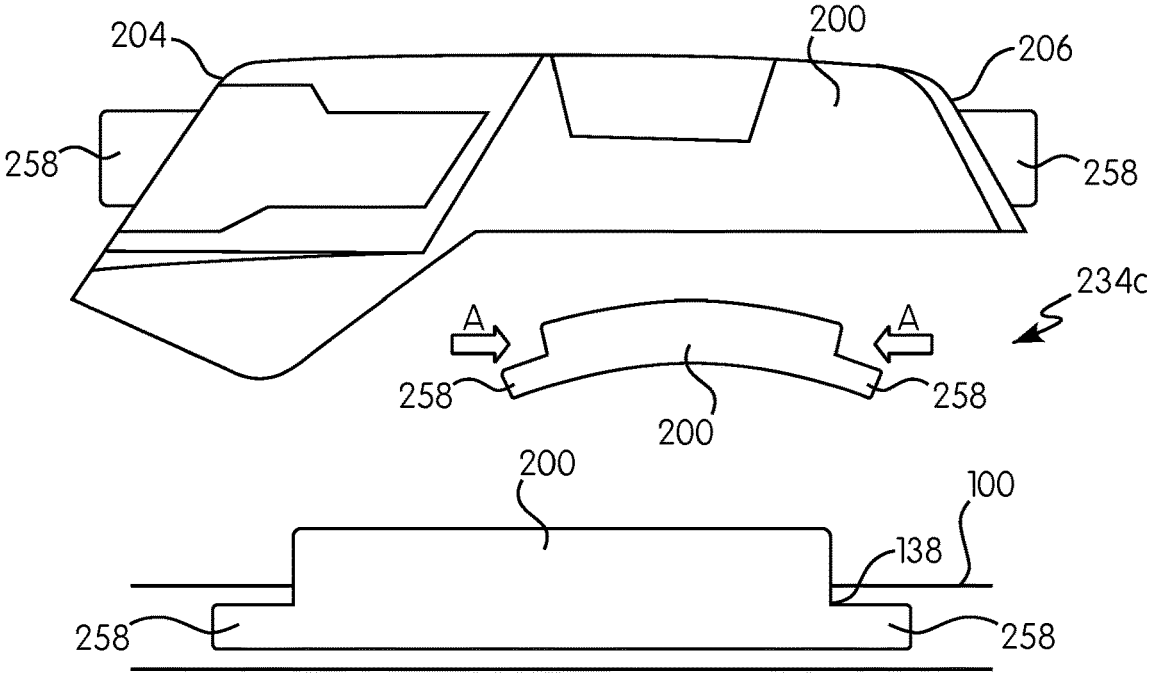
FIG. 8 is a perspective view of a portion of a protective helmet and an accessory attachment rail in accordance with another non-limiting embodiment or aspect.

With reference to FIG. 8, one or more connection elements 234*c* is shown in accordance with another embodiment or aspect. The one or more connection elements 234*c* may be formed as a pair of tabs 258, with one tab 258 protruding away from the front end 204 of the accessory attachment rail 200 and the other tab 258 protruding away from the rear end 206. The tabs 258 may be co-planar with the body 206 of the accessory attachment rail 200. In some non-limiting embodiments or aspects, the body 202 and the tabs 258 may be made from a flexible material that allows bending of the accessory attachment rail about its longitudinal plane when a compressive force is applied in the direction of arrows A in FIG. 8. By compressing the tabs 258 toward each other, the body 202 of the accessory attachment rail 200 can be bent to allow insertion of the tabs 258 into the corresponding openings 132 on the helmet 100. After releasing the compressive force on the tabs 258, the accessory attachment rail 200 can revert to its initial shape, which prevents removal of the tabs 258 from the openings 132 on the helmet 100.

Figure 9:
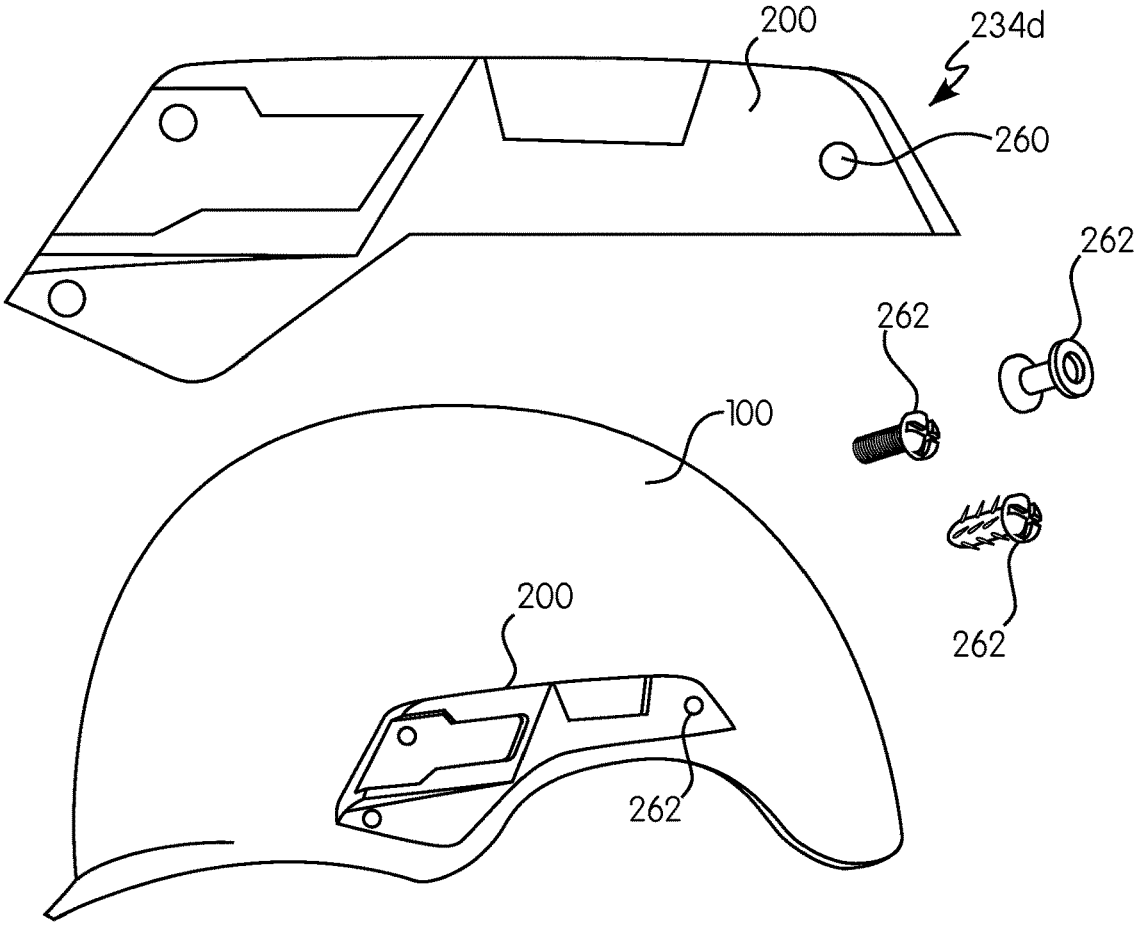
FIG. 9 is a perspective view of a protective helmet and an accessory attachment rail in accordance with another non-limiting embodiment or aspect.

With reference to FIG. 9, one or more connection elements 234*d* is shown in accordance with another embodiment or aspect. The one or more connection elements 234*d* may be formed as one or more through holes 260 that extend through the body 202 of the accessory attachment rail 200. The spacing of the one or more through holes 260 may correspond to the spacing of one or more openings 132 on the helmet 100. In this manner, by aligning the through holes 260 on the accessory attachment rail 200 with the openings 132 on the helmet 100, the accessory attachment rail 200 can be connected to the helmet 100 by inserting a fastener 262 through each through hole 260/opening 132 pair. In some non-limiting embodiments or aspects, the fastener 262 may be a screw, push pin, rivet, or a similar mechanical connection element. The fastener 262 may be configured for non-removably connecting the accessory attachment rail 200 to the helmet 100 to prevent removal of the accessory attachment rail 200 from the helmet 100. In other non-limiting embodiments or aspects, the fastener 262 may be configured for removably connecting the accessory attachment rail 200 to the helmet 100 to allow free installation and removal of the accessory attachment rail 200 to and from the helmet 100.

Figure 10:
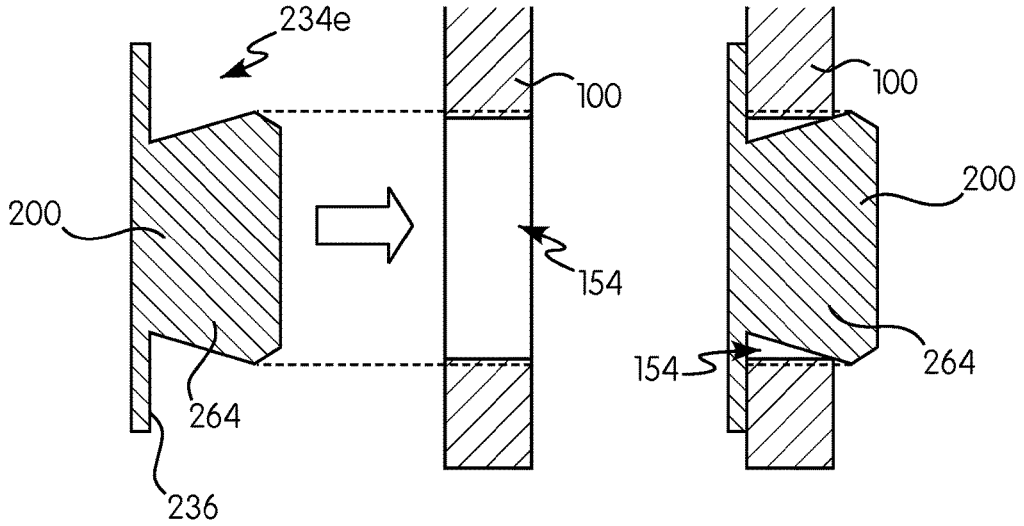
FIG. 10 is a bottom view of a portion of a protective helmet and an accessory attachment rail in accordance with another non-limiting embodiment or aspect.

With reference to FIG. 10, one or more connection elements 234*e* is shown in accordance with another embodiment or aspect. The one or more connection elements 234*e* may be formed as a tapered flange 264 that protrudes from the inner surface 236 of the accessory attachment rail 200 in a direction toward the outer surface of the helmet 100. A width of the tapered flange 264 may increase in a direction from the inner surface 236 of the accessory attachment rail 200 toward the outer surface of the helmet 100. The tapered flange 264 is configured for being received within a cutout 154 on the helmet 100. In some non-limiting embodiments or aspects, the tapered flange 264 may be configured for a press fit or an interference fit with the cutout 154 to prevent removal of the accessory attachment rail 200 from the helmet 100 after the tapered flange 264 is inserted into the cutout 154.

Figure 11:
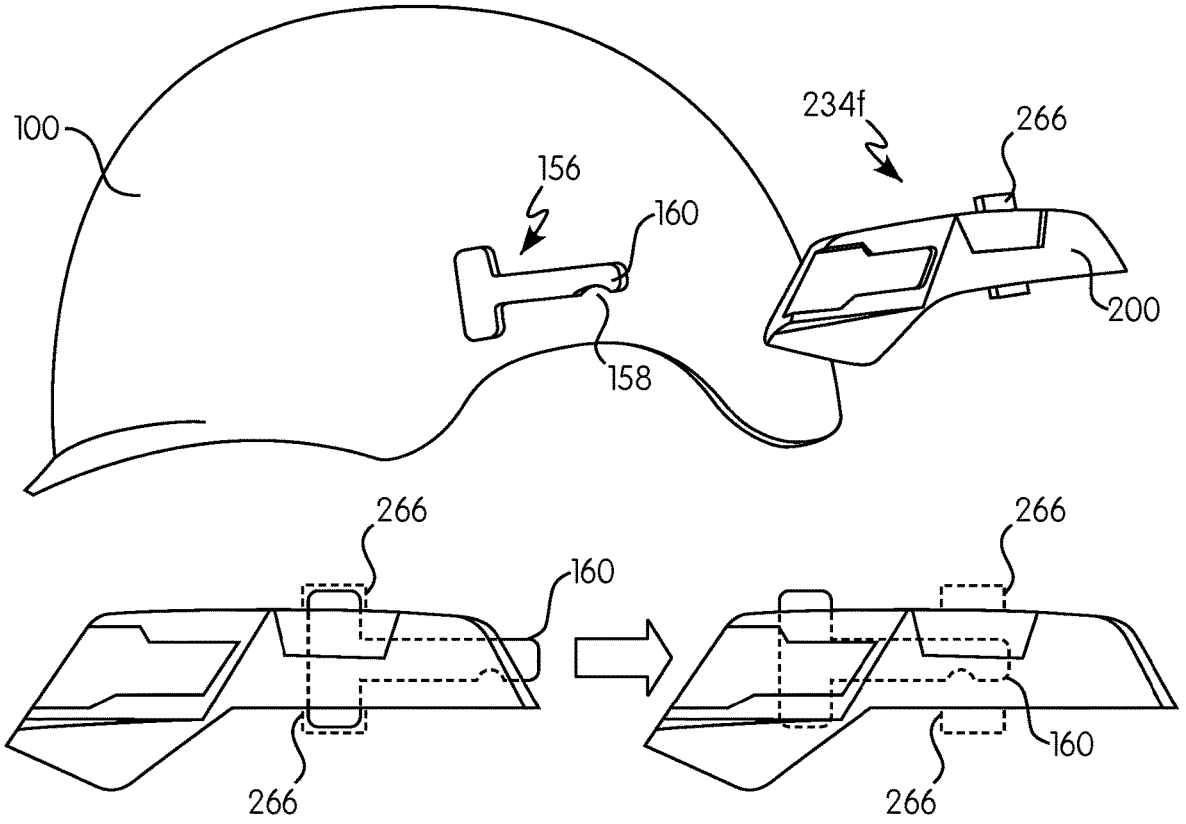
FIG. 11 is a perspective view of a protective helmet and an accessory attachment rail in accordance with another non-limiting embodiment or aspect.

With reference to FIG. 11, one or more connection elements 234*f* is shown in accordance with another embodiment or aspect. The one or more connection elements 234*f* may be formed as a knob 266 that protrudes from the inner surface 236 of the accessory attachment rail 200 in a direction toward the outer surface of the helmet 100. The knob 266 is configured for being received within a slot 156 on the helmet 100. The slot 156 may be shaped such that the knob 266 may be inserted at a first end of the slot 156. The knob 266 may be movable within the slot 156 toward a second end to allow for locking of the knob 266 within the slot 156. In some non-limiting embodiments or aspects, one or more ramps 158 may be provided on a guiding surface 160 of the slot 156 to prevent removal of the accessory attachment rail 200 from the helmet 100 after the knob 266 is inserted into the slot 156 and over the one or more ramps 158. The knob 266 and the slot 156 define a keyed connection arrangement with a "slide-to-lock" feature.

Figure 12:
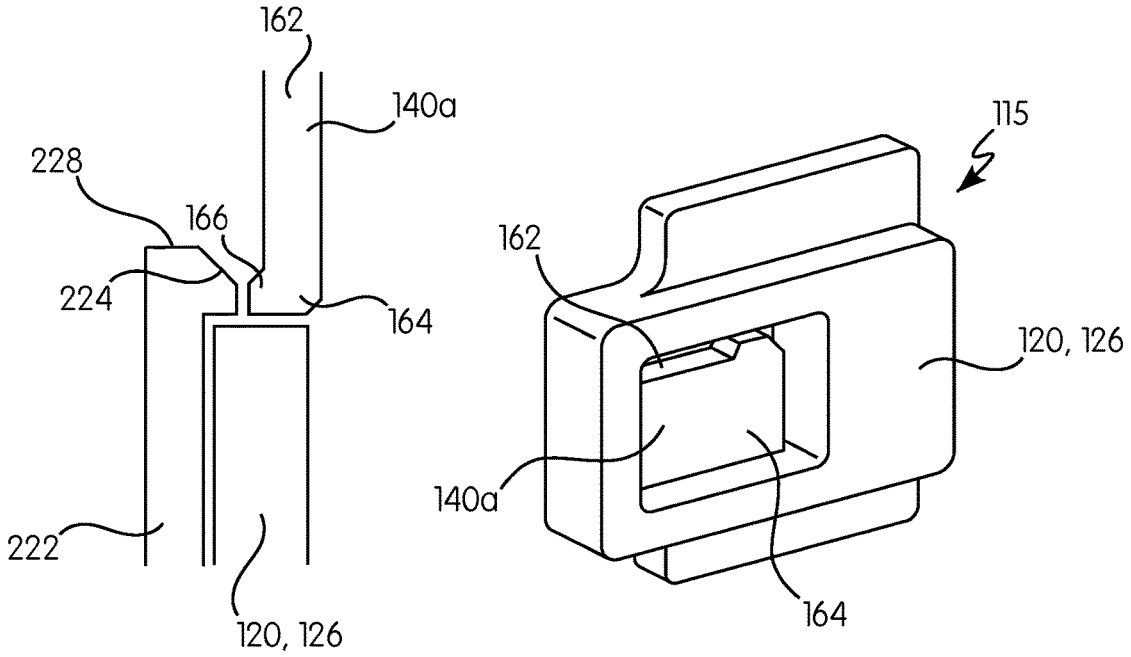
FIG. 12 is a perspective view of a portion of a protective helmet and an accessory attachment rail in accordance with another non-limiting embodiment or aspect.

With reference to FIG. 12, a release button 140*a* for use with the frame 120, 126 of the helmet accessory 115 is shown in accordance with another embodiment or aspect. Instead of being formed as a distinct component that is separate from the frame 120, 126 (shown in FIGS. 5A-5B), the release button 140*a* is formed directly on the frame 120, 126 as an integral, monolithic component of the frame 120, 126. In some non-limiting embodiments or aspects, the release button 140*a* may be configured as a cantilever having a first end 162 connected to the frame 120, 126 and a second, free end 164 deflectable relative to the first end 162. The second end 164 has a catch 166 that interacts with the locking tab 224 on the accessory attachment rail 200. The catch 166 is configured for contacting the locking tab 224 and deflecting the locking tab 224 with the pressing of the release button 140*a* in a direction toward the helmet 100. Such movement of the release button 140 deflects the second end 228 of the locking beam 222 such that the locking tab 224 disengages from the lip on the frame 120, 126 to allow the frame 120, 126 to be removed from the slot 208.

Figure 13:
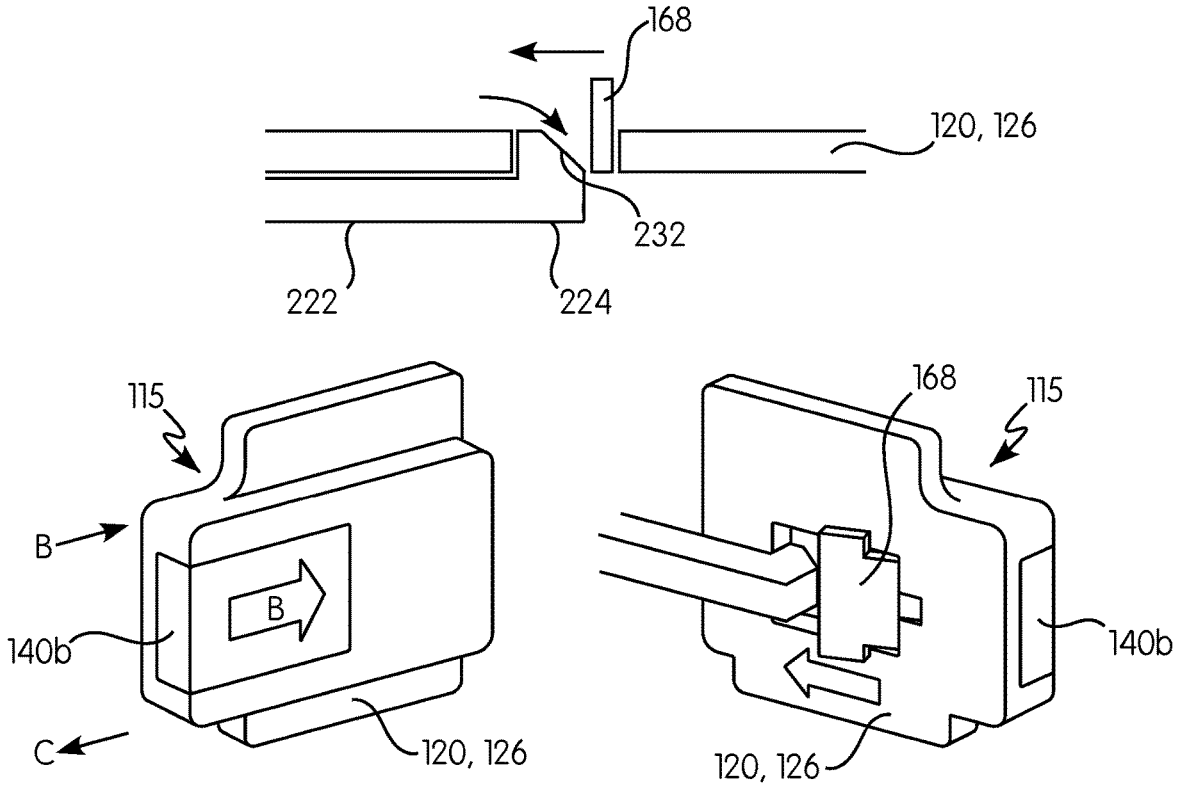
FIG. 13 is a perspective view of a portion of a protective helmet and an accessory attachment rail in accordance with another non-limiting embodiment or aspect.

With reference to FIG. 13, a release button 140*b* on the frame 120, 126 of the helmet accessory 115 is shown in accordance with another embodiment or aspect. In some non-limiting embodiments or aspects, the release button 140*b* may be configured as a slider button that is configured for a sliding movement relative to the frame 120, 126 in a direction substantially parallel with a longitudinal axis of the frame 120, 126. The release button 140*b* is movable relative to the frame 120, 126 in a direction of arrow B from an initial position toward a release position. A biasing mechanism, such as a spring, may be provided for biasing the release button 140*b* to the initial position. In this manner, after moving the release button 140*b* to the release position, the biasing mechanism may urge the release button 140*b* back toward the initial position in a direction of arrow C. The release button 140*b* may have a release tab 168 that is slidable relative to the frame 120, 126 between the initial position and the release position. With movement of the release button 140*b* toward the release position, the release tab 168 contacts the tapered leading surface 232 of the locking beam 222 on the accessory attachment rail 200, thereby causing the locking beam 222 to deflect and allowing the frame 120, 126 to be removed from the slot 208.

Figure 14:
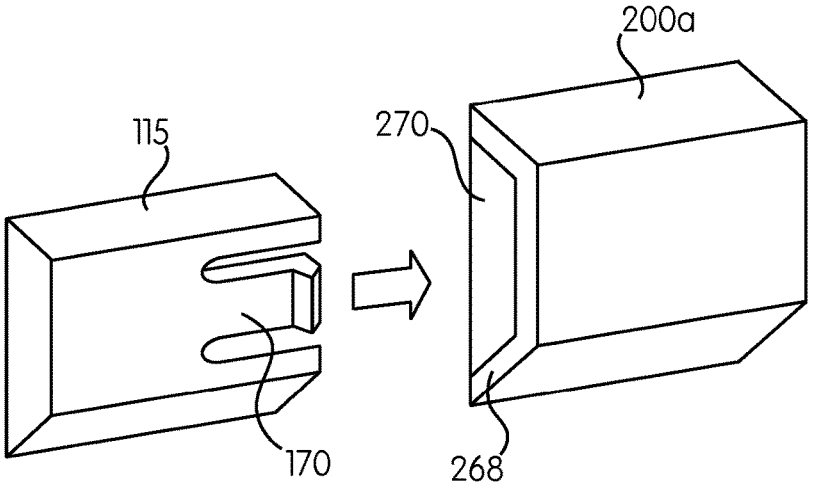
FIG. 14 is a perspective view of a portion of a protective helmet and an accessory attachment rail in accordance with another non-limiting embodiment or aspect.

With reference to FIG. 14, an accessory attachment rail 200*a* is shown in accordance with another embodiment or aspect. The accessory attachment rail 200*a* has a locking mechanism for attaching a corresponding helmet accessory 115. In some non-limiting embodiments or aspects, the locking mechanism may be formed as a receptacle 268 having an opening 270 configured for receiving a flexible snap 170 formed on the helmet accessory 115. The flexible snap 170 is configured to deflect from its initial state during insertion of the snap 170 into a first end of the opening 270 of the receptacle 268. Once the snap 170 exits through a second end of the opening 270, the flexible snap 170 may "snap" back to its initial state, thereby preventing removal of the helmet accessory 115 from the accessory attachment rail 200*a* without flexing or deflecting the snap 170 to a release state.

Figure 15:
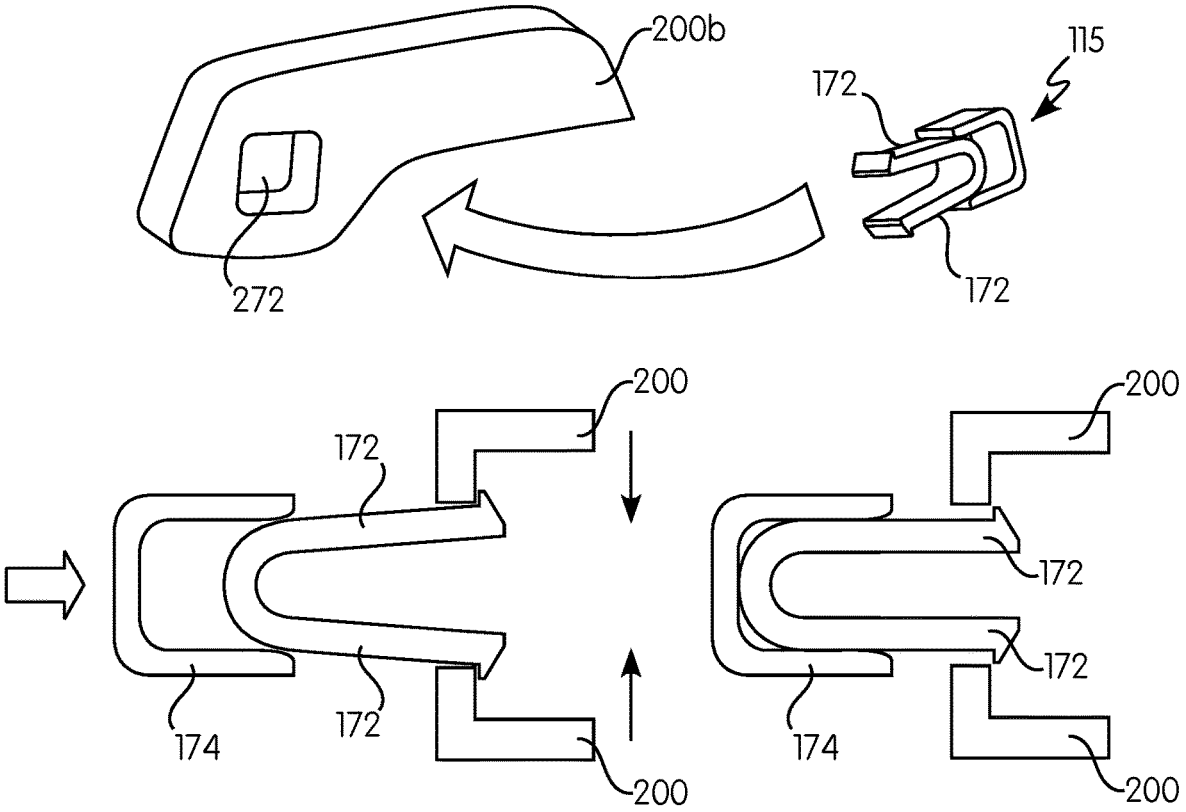
FIG. 15 is a perspective view of a portion of a protective helmet and an accessory attachment rail in accordance with another non-limiting embodiment or aspect.

With reference to FIG. 15, an accessory attachment rail 200*b* is shown in accordance with another embodiment or aspect. The accessory attachment rail 200*b* has a locking mechanism for attaching a corresponding helmet accessory 115. In some non-limiting embodiments or aspects, the locking mechanism may be formed as an aperture 272 configured for receiving flexible legs 172 formed on the helmet accessory 115. The flexible legs 172 are configured to deflect from their initial state during insertion of the legs 172 into a first end of the aperture 272. Once the legs 172 exit through a second end of the aperture 272, the flexible legs 172 may "snap" back to their initial state, thereby preventing removal of the helmet accessory 115 from the accessory attachment rail 200*b* without flexing or deflecting the flexible legs 172 to a release state. In some embodiments or aspects, a release member 174 is provided to urge the flexible legs 172 toward a flexed or release state. The release member 174 is configured to translate along a longitudinal length of the flexible legs 172, thereby urging the legs 172 toward each other with continued movement of the release member 174.

Figure 16:
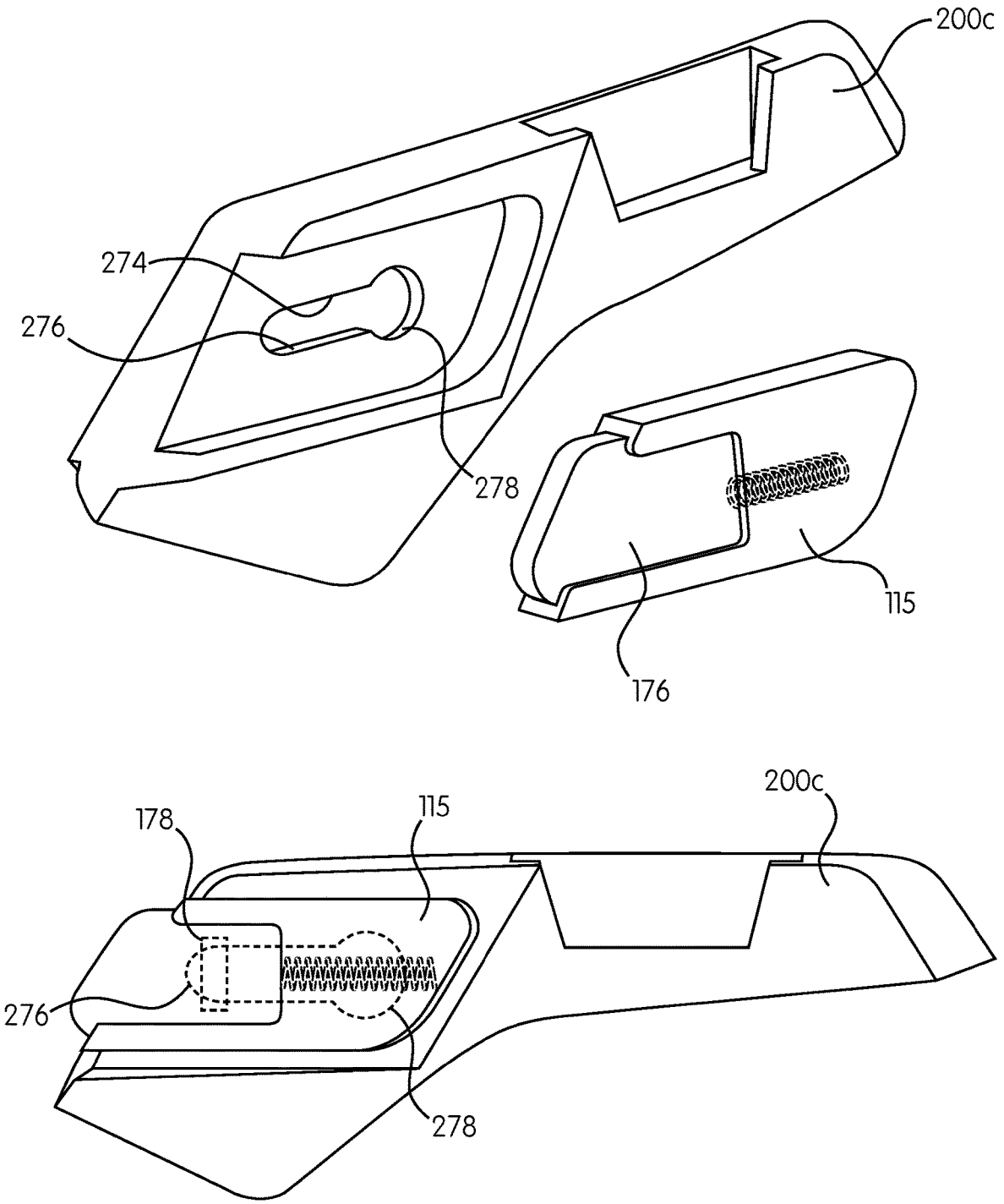
FIG. 16 is a perspective view of a portion of a protective helmet and an accessory attachment rail in accordance with another non-limiting embodiment or aspect.

With reference to FIG. 16, an accessory attachment rail 200*c* is shown in accordance with another embodiment or aspect. The accessory attachment rail 200*c* has a locking mechanism for attaching a corresponding helmet accessory 115. In some non-limiting embodiments or aspects, the locking mechanism may be formed as a keyed slot 274 configured for receiving a spring-loaded locking tab 176 formed on the helmet accessory 115. The keyed slot 274 has a first portion 276 and a second portion 278, wherein a width of the first portion 276 is smaller than a width of the second portion 278. The locking tab 176 has a locking head 178 having a width that is smaller than a width of the second portion 278 of the keyed slot 274 but larger than the width of the first portion 276 of the keyed slot 274. In this manner, the locking head 178 can be inserted into and removed from the second portion 278, but not the first portion 276 of the keyed slot 274. Upon insertion of the locking head 178 into the second portion 278 of the keyed slot 274, the spring-loaded locking tab 176 may urge the locking head to slide along the channel of the first portion 276 of the keyed slot 274. Due to the width of the locking head 178, the locking tab 176 cannot be removed from the keyed slot 274. By sliding or urging the locking tab 176 toward the second portion 278, the locking tab 176 can be removed from the keyed slot 274 when the locking head 178 is positioned within the second portion 278. A biasing mechanism, such as a spring 180, may be provided for biasing the locking tab 176 toward the first portion 276 of the keyed slot 274. In this manner, after insertion of the locking head 178 into the second portion 278 of the keyed slot 274, the spring 180 may urge the locking tab 176 toward the first portion 276 of the keyed slot 274, thereby preventing removal of the helmet accessory from the accessory attachment rail 200*c*.

It is understood that the invention is not limited to the embodiments described above by way of examples but that it comprises all the technical equivalents and the variants of the means described as well as their combinations. Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A protective helmet comprising:

an outer shell configured for surrounding a head of a user;

at least one accessory attachment rail connected to the outer shell, the accessory attachment rail comprising:

a body having a front end, a rear end, and one or more slots between the front end and the rear end, each of the one or more slots configured for removably receiving at least one helmet accessory;

a locking mechanism associated with each of the one or more slots for automatically locking the at least one helmet accessory in the one or more slots upon insertion of the at least one helmet accessory within the one or more slots and for preventing removal of the at least one helmet accessory from the one or more slots until the locking mechanism is unlocked; and at least one connection element for connecting the accessory attachment rail to the outer shell, wherein each of the one or more slots has an open end configured for removably receiving the at least one helmet accessory, a closed end opposite the open end, and a channel having a perimeter wall between the open end and the closed end.

2. The protective helmet of claim 1, wherein the locking mechanism comprises a locking beam having a first end connected to at least a portion of the one or more slots and a second free end movable relative to the first end in a direction toward an outer surface of the helmet when deflected by the at least one helmet accessory during insertion of the at least one helmet accessory into the one or more slots.

3. The protective helmet of claim 2, wherein the second free end of the locking beam has a locking tab configured for engaging a corresponding locking slot on the at least one helmet accessory when the at least one helmet accessory is fully inserted into the one or more slots.

4. The protective helmet of claim 3, wherein the locking tab has a tapered leading surface that is angled toward the open end of the one or more slots.

5. The protective helmet of claim 1, wherein the at least one connection element is a plurality of deflectable tabs spaced around an inner surface of the accessory attachment rail facing an outer surface of the outer shell, each of the plurality of deflectable tabs configured for insertion into an opening formed on the outer shell.

6. The protective helmet of claim 5, wherein each of the plurality of deflectable tabs has a first end connected to the body of the accessory attachment rail and a second end protruding relative to the first end in a direction away from the inner surface and toward the outer surface of the outer shell.

7. The protective helmet of claim 5, wherein each deflectable tab has a lip for engaging a corresponding ledge on the outer shell.

8. The protective helmet of claim 1, wherein the at least one connection element is a plurality of annular snaps having a post defined by a pair of deflectable beams separated from each other by a space, each of the plurality of annular snaps configured for insertion into an opening formed on the outer shell.

9. The protective helmet of claim 8, wherein each of the deflectable beams has a first end connected to the body of the accessory attachment rail and a second free end protruding from the body in a direction toward an outer surface of the outer shell.

10. The protective helmet of claim 1, wherein the at least one connection element is a projection that protrudes from an inner surface of the body in a direction toward an outer surface of the outer shell, the projection being configured for insertion into a receiving slot protruding away from the outer surface of the outer shell.

11. The protective helmet of claim 1, wherein the at least one connection element is a pair of tabs protruding from the front end and the rear end of the body.

12. The protective helmet of claim 1, wherein the at least one connection element is at least one through hole extending through the body and configured to receive a fastener therethrough to connect the accessory attachment rail to the outer shell.

13. The protective helmet of claim 1, further comprising the at least one helmet accessory.

14. The protective helmet of claim 13, wherein the at least one helmet accessory is at least one of a face shield, earmuffs, and a headlamp.

15. The protective helmet of claim 13, wherein the at least one helmet accessory comprises a frame movable between a first or active position and a second or inactive position by pivoting relative to the accessory attachment rail about a pivot point.

16. An accessory attachment rail for a protective helmet, the accessory attachment rail comprising:

a body having a front end, a rear end, and one or more slots between the front end and the rear end, each of the one or more slots configured for removably receiving at least one helmet accessory;

a locking mechanism associated with each of the one or more slots for automatically locking the at least one helmet accessory in the one or more slots upon insertion of the at least one helmet accessory within the one or more slots and for preventing removal of the at least one helmet accessory from the one or more slots until the locking mechanism is unlocked; and at least one connection element for connecting the accessory attachment rail to an outer shell of the protective helmet, wherein each of the one or more slots has an open end configured for removably receiving the at least one helmet accessory, a closed end opposite the open end, and a channel having a perimeter wall between the open end and the closed end.

17. The accessory attachment rail of claim 16, wherein the locking mechanism comprises a locking beam having a first end connected to at least a portion of the slot and a second free end movable relative to the first end in a direction toward an outer surface of the helmet when deflected by the at least one helmet accessory during insertion of the at least one helmet accessory into the one or more slots.

18. The accessory attachment rail of claim 17, wherein the second free end of the locking beam has a locking tab configured for engaging a corresponding locking slot on the at least one helmet accessory when the at least one helmet accessory is fully inserted into the one or more slots.

19. The accessory attachment rail of claim 16, wherein the at least one connection element is a plurality of deflectable tabs spaced around an inner surface of the accessory attachment rail facing an outer surface of the outer shell, each of the plurality of deflectable tabs configured for insertion into an opening formed on the outer shell.

* * * * *